US006305148B1

(12) United States Patent
Bowden et al.

(10) Patent No.: US 6,305,148 B1
(45) Date of Patent: Oct. 23, 2001

(54) SYSTEM AND METHOD PROVIDING A REGULATED ATMOSPHERE FOR PACKAGING PERISHABLE GOODS

(75) Inventors: Lisa A. Bowden, Aptos; James S. Nagamine, Watsonville, both of CA (US)

(73) Assignee: The Bowden Group, Aptos, CA (US)

( * ) Notice: Subject to any disclaimer, the term of this patent is extended or adjusted under 35 U.S.C. 154(b) by 0 days.

(21) Appl. No.: 09/393,047

(22) Filed: Sep. 9, 1999

Related U.S. Application Data

(60) Provisional application No. 60/099,728, filed on Sep. 10, 1998.

(51) Int. Cl.[7] ..... B65B 31/04

(52) U.S. Cl. ..... 53/432; 53/510; 53/508; 206/386; 206/524.8

(58) Field of Search ..... 53/432, 434, 465, 53/510, 512, 399, 508; 426/419, 418, 396, 395; 206/386, 597, 524.8

(56) References Cited

U.S. PATENT DOCUMENTS

| | | | | |
|---|---|---|---|---|
| 2,445,152 | * | 7/1948 | Poole | 53/432 |
| 3,429,095 | * | 2/1969 | Huson | 53/434 |
| 3,756,396 | * | 9/1973 | Kilroy | 206/386 |
| 3,850,214 | * | 11/1974 | Hickey | 206/524.8 X |
| 4,000,815 | | 1/1977 | Wingbro et al. . | |
| 4,055,931 | | 11/1977 | Myers . | |
| 4,066,401 | * | 1/1978 | Solomon | 426/419 |
| 4,114,668 | * | 9/1978 | Hickey | 206/524.8 X |
| 4,224,347 | | 9/1980 | Woodruff . | |
| 4,243,349 | * | 1/1981 | Hickey et al. | 206/524.8 |
| 4,356,702 | | 11/1982 | Kuttel . | |
| 4,411,918 | | 10/1983 | Cimino et al. . | |
| 4,422,304 | | 12/1983 | Kuttel . | |
| 4,502,519 | * | 3/1985 | Clements . | |
| 4,821,489 | | 4/1989 | MacLeod et al. . | |
| 4,843,956 | | 7/1989 | Lashlee . | |
| 4,886,372 | | 12/1989 | Greengrass et al. . | |
| 4,987,745 | | 1/1991 | Harris . | |
| 5,016,761 | | 5/1991 | Stoddard et al. . | |
| 5,028,443 | * | 7/1991 | Wade | 426/419 |
| 5,046,302 | | 9/1991 | Bolejack et al. . | |
| 5,111,639 | | 5/1992 | Bolejack et al. . | |
| 5,236,099 | | 8/1993 | Fties et al. . | |
| 5,251,753 | * | 10/1993 | Pigott | 206/386 |
| 5,314,286 | | 5/1994 | Bolejack et al. . | |
| 5,316,178 | | 5/1994 | Garber, Jr. . | |
| 5,458,899 | | 10/1995 | Floyd et al. . | |
| 5,497,698 | | 3/1996 | Bolkestein . | |
| 5,505,950 | | 4/1996 | Floyd et al. . | |
| 5,560,947 | | 10/1996 | Bell . | |
| 5,658,607 | | 8/1997 | Herdeman . | |
| 5,738,890 | | 4/1998 | Cadiente et al. . | |
| 5,747,082 | | 5/1998 | Floyd et al. . | |
| 5,945,147 | * | 8/1999 | Borchard | 53/434 |
| 5,950,402 | * | 9/1999 | Hoddinott | 53/402 |

* cited by examiner

*Primary Examiner*—Stephen F. Gerrity
(74) *Attorney, Agent, or Firm*—Baker & McKenzie

(57) ABSTRACT

The invention provides a new method and system for establishing, and optionally maintaining, a desired atmosphere for perishable or atmosphere-sensitive goods during their storage and/or transportation. One embodiment includes providing a sealed enclosure around the goods; coupling at least one valve to the sealed enclosure so as to provide a port through which a desired gas from an external gas source may enter the sealed enclosure; coupling a first end of a hose to the at least one valve and a second end of the hose to the external gas source, thereby providing a conduit through which the desired gas may flow from the external gas source into the sealed enclosure; injecting a desired gas from the external gas source into the sealed enclosure so as to provide a desired atmosphere within the sealed enclosure; automatically monitoring an amount of gas which enters the sealed enclosure from the external source; and automatically controlling the flow of the desired gas into the sealed enclosure in response to the act of automatically monitoring.

21 Claims, 12 Drawing Sheets

SYSTEM AND METHOD PROVIDING A REGULATED ATMOSPHERE FOR PACKAGING PERISHABLE GOODS

RELATED APPLICATIONS

This application claims priority under 35 U.S.C. § 119(e) from U.S. Provisional Application Ser. No. 60/099,728, filed Sep. 10, 1998, entitled "System and Method Providing a Regulated Atmosphere for Packaging Perishable Goods."

FIELD OF THE INVENTION

The present invention relates to a method and apparatus for creating a sealed enclosure around perishable or atmosphere-sensitive products for transport or storage. More particularly, the invention relates to a storage method and system for enclosing goods being transported, on a pallet, for example, providing a desired environment or atmosphere within the enclosure, and optionally monitoring and controlling the environment or atmosphere within the enclosure during transport.

BACKGROUND OF THE INVENTION

Perishable or environmentally sensitive goods risk damage from numerous sources such as wind, dirt, heat, insects, etc. during transportation. Various forms of packaging have been used to minimize damage or decay of such goods. For example, goods are often secured to a pallet to facilitate the transport of such goods and to protect the goods from damage caused by shifting during transport. In order to further protect and preserve the goods during transport, it is well known to cover the goods so as to form an enclosure around the goods. Known techniques to create an enclosure include heat shrinking plastic around the goods which has been placed on a pallet or placing a plastic bag around the goods on a pallet. By forming such an enclosure, referred to as a "sealed enclosure" herein, the goods can be protected from environmental factors such as moisture or other contaminants. The more airtight the sealed enclosure, the better the sealed enclosure protects the goods from external contaminants.

FIG. 1 shows a well-known apparatus 50 for storing goods during transport. The apparatus 50 includes a base cap 10 positioned over a pallet 30. After the base cap 10 is positioned on the pallet 30, the base cap 10 is usually held in place by the goods 40 that are stacked on top of the base cap 10. The base cap 10 further includes side flaps or walls 12 which extend upwardly from the peripheral edges of the base cap 10, for surrounding and holding the goods 40 within their boundaries. Typically, the goods 40 are then further secured to the base cap 10 and the pallet 30 with staples or some type of tape that wraps around the goods 40 and the base cap 10.

The base cap 10 forms a barrier between the goods 40 and the pallet 30 and is typically made from some type of plastic, relatively impermeable material shaped to fit over the pallet 30. The base cap 10 seals and protects the bottom surface of the goods 40 from contamination and also provides a surface to which the goods 40 can be secured. The base cap 10 can be any shape or material, but is preferably sized to cover the pallet 30 and preferably made of a relatively water and gas impermeable material to form a seal barrier at the underside of the goods 40. Goods 40 are stacked on the base cap 10 which is placed on top of the pallet 30. The goods 40 can be a variety of types or sizes and preferably are in boxes or containers. While three layers of boxed goods 40 are shown, there can be more or less layers. The combination of stacked goods 40 on the base cap 10 and the pallet 30, as illustrated in FIG. 1, is referred to herein as the loaded pallet 50.

FIG. 2 illustrates a well-known method of creating a sealed enclosure around the loaded pallet 50 of FIG. 1. A bag-like covering 90 is placed around the goods 40 and secured to the base cap 10 of the loaded pallet 50, thereby forming a sealed enclosure around the goods 40. Preferably, the bag covering 90 is adhered to the base cap 10 and the pallet 30 with tape, or other well-known technique, to create an airtight seal.

Prior art enclosure systems, such as those discussed above, suffer from many disadvantages. Using a bag covering 90 to form the enclosure, as shown in FIG. 2, is disadvantageous in that it is difficult to seal the bottom end of the cover 90 with the base cap 10. The bag covering 90 is often larger than the base cap 10, so sealing the bag covering 90 to the base cap 10 requires folding and creasing of the bag covering 90. The folding and creasing of the bag covering 90 to fit the base cap 10 prevents a smooth contact between the inside surface of the bag covering 90 and outside edges of the base cap 10. Furthermore, the folds and creases form possible gaps or channels for gases to bypass the seal, thus, preventing an airtight enclosure.

Likewise, when wrapping plastic around palletized goods, it is difficult to completely seal the enclosure, especially at the top and bottom sides. The wrapping must curve around the corners and edges of goods 40, leading to potential gaps or creases in the wrapping. As previously discussed, the gaps and creases are undesirable in that they provide possible channels for air to escape or enter the sealed enclosure.

After the goods 40 have been loaded onto the pallet 30 and sealed by some method, such as by covering 90 and base cap 10 as described above, the goods 40 can be further protected and preserved by providing a modified atmosphere inside the enclosure surrounding the goods 40. For example, it is well known to inject gases such as nitrogen and carbon dioxide within the enclosure in order to deter deterioration of the goods, for example, by the growth of organisms that may contribute to the natural deterioration of produce. Other mixtures of gases can help maintain the goods 40 if held at an appropriate temperature and humidity.

Good sealed enclosures are especially important in these modified air systems. If the sealed enclosure leaks, the beneficial gases may escape. Furthermore, a change in the composition of gases in the enclosure may damage the goods. For example, an excessive amount of $CO_2$ in the enclosure may cause food to discolor and to change taste.

The predominant present technique for introducing the modified atmosphere into the sealed enclosure is to inject the gas mixture through a needle-tipped hose. The needle-tipped hose is inserted through the covering of a sealed enclosure (such as bag covering 90 in FIG. 2). The needle-tipped hose is then taped to the covering and a desired gas mixture is injected through the hose into the sealed enclosure. The process ends by removal of the needle-tipped hose from the enclosure and re-sealing of the resulting hole in the covering with tape or other adhesive.

This present system for introducing the modified atmosphere into the sealed enclosure is disadvantageous. The steps of manually piercing the enclosure to insert the needle hose and resealing the resulting hole are labor extensive, adding cost and delays to the shipping process. The process of piercing and resealing the enclosure is also undesirable in that it may create a potential leak in the enclosure. The tape or adhesive may not seal properly, creating leaks in the sealed enclosure.

Another disadvantage of the present enclosed pallet transport systems is that they do not allow the user to monitor and adjust the atmosphere within the sealed enclosure during storage or transport. A typical result of this shortcoming is that the atmosphere deteriorates during storage or transport. For example, respiration of produce will accelerate the ripening and aging of produce during transport and will change the quality of the gases in the enclosure. As a result, the goods may deteriorate during transport, especially if delayed by unforeseen circumstances.

Furthermore, the transporter cannot adjust the atmosphere to accommodate a good with varying needs. For example, the ripening of fruits is generally undesirable during transport and storage but may be desirable as the fruits near their final markets. It is well known that certain combinations of gases prevent the ripening of fruits while others encourage the fruits to ripen. Thus it is desirable to have the enclosure containing the former gas mixture during most of transport, but changing to the latter gas mixture as the fruits near their final markets.

It is also known to be beneficial to provide a controlled environment around the goods 40 during transportation and storage. For example, the goods 40 can be transported in refrigerated trucks, ships, or railcars. Within the cargo holding area of specialized transport vehicles, the temperature or atmospheric contents around the goods can be adjusted and controlled during transport. However, transportation of goods by these environment controlling vehicles has several problems. Foremost, most transport vehicles do not have the ability control the atmospheric environment of the cargo holding area. For example, most trucks have the capacity to only maintain the cool temperature of their cargo. Environmental control requires additional specialized equipment and this specialized equipment significantly raises the costs for the transport vehicle, ship, or storage facility. As a result, there are not enough environment controlling vehicles to transport goods. Transportation of a larger range of goods in controlled environments could provide significant benefits to the consumer by reducing loss of goods during transport A further disadvantage of current vehicles having a combined temperature and controlled atmosphere enclosure is the dehydration of products during storage (due to evaporation through cooling). Much energy is required to cool a large enclosure. The energy consumption raises fuel and transportation costs.

Thus, in view of the deficiencies and problems associated with prior art methods and systems for storing and transporting perishable or environment-sensitive goods, an improved method and system of transporting such goods is needed. A method and system for more easily and efficiently creating a sealed enclosure around the perishable goods is desired. What is further needed is a method and system which can provide, monitor and/or maintain a controlled environment within the sealed enclosure of a standard pallet, bin or other shipping unit without the use of expensive, specialized vehicles having atmosphere-controlled cargo holds, such as ships, specialized sea containers, and refrigerated trucks, for example.

SUMMARY OF THE INVENTION

The present invention alleviates many of the disadvantages of known apparatus and methods for transporting perishable goods by providing an apparatus and method for creating a sealed enclosure around perishable goods stacked on a pallet, bin, or storage unit and further providing a method and apparatus for establishing and maintaining a protective atmosphere within the sealed pallet, bin or storage unit enclosure.

In one embodiment, the invention creates a sealed enclosure around perishable goods for transport using a pallet, a base cap, a valve coupled to the base cap, and a covering. The base cap is first positioned onto the pallet. Optional tabs in the base cap help position and hold the base cap onto the pallet. Next, the goods are placed on top of the base cap. Next, the covering is placed over the goods and sealed at the bottom to the base cap to complete the enclosure. Finally, desired gases, such as nitrogen, for example, are introduced or "exchanged" into the sealed enclosure via the valve coupled to the base cap from sources such as liquid or pressurized gas tanks, for example. After a desired amount of select gases is introduced, the valve is closed so as to prevent or minimize gas leakage from the sealed enclosure.

In another embodiment, the inventor includes a pallet, a base cap, a top cap, and a wrapping to be wrapped around goods positioned between the top and base caps. Optionally, one or more valves for allowing desired gases to either enter or exit the sealed enclosure may be provided on either the base cap, the top cap, or both. After the sealed enclosure is formed, desired gases may be introduced through one or more of the valves.

In another embodiment, each of the methods and systems, described above, further includes a sensor, for measuring and/or monitoring the atmosphere or pressure within the enclosure, and a controller (e.g., a programmable logic controller) for controlling the amount of desired gases introduced into the sealed enclosure. The amount of select gas present in, or introduced into, the enclosure is monitored and/or measured by the sensor which is in turn coupled to the controller, or other well-known processor. By receiving data from the sensor, the controller may either open or close the valve to either start or stop the inflow of gas from the gas tanks into the enclosure. Optionally, the controller may be disconnected from the sealed enclosure after an initial desired atmosphere is achieved, or the controller can remain attached to the system during storage or transportation so as to continually monitor and maintain the desired atmosphere throughout the duration of the trip or storage period.

DETAILED DESCRIPTION OF THE INVENTION

The invention is described in detail below with reference to the figures, wherein like elements are referred to with like numerals throughout. In accordance with the present invention, a method and apparatus for creating a sealed enclosure around perishable or atmosphere-sensitive products for storage and transport (e.g. palletized goods), introducing a desired atmosphere into the sealed enclosure, and optionally maintaining a controlled atmosphere within the enclosure during transportation of the goods, is provided.

Figure 1:
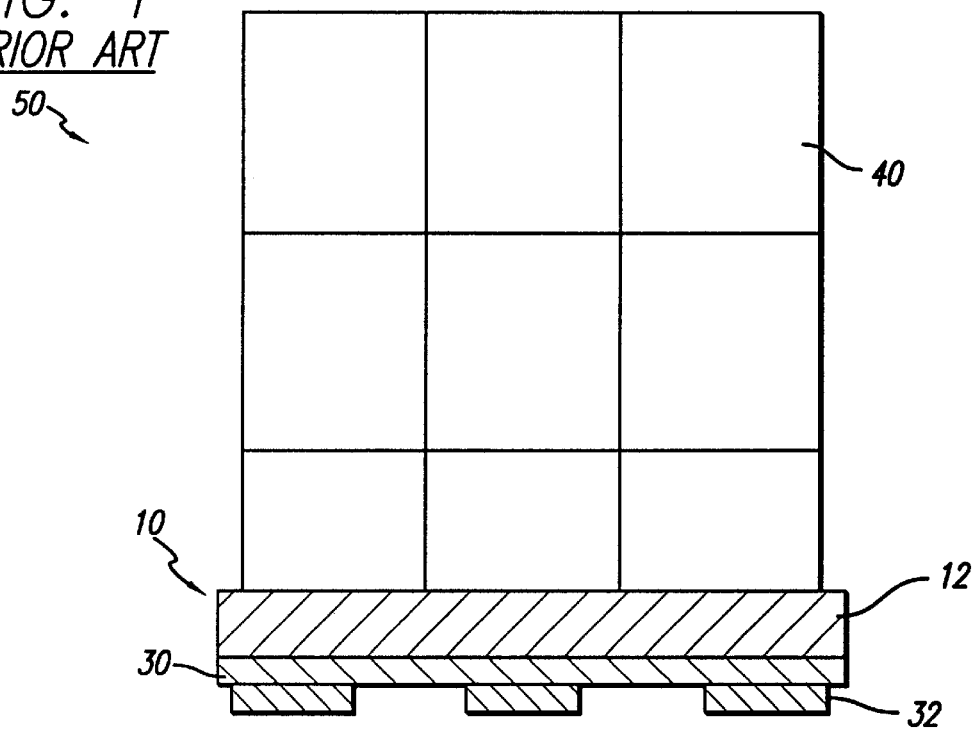
FIG. 1 PRIOR ART
FIG. 1 illustrates a prior art method and system of packaging goods on a pallet by placing a base cap between the goods and the pallet.
Figure 2:
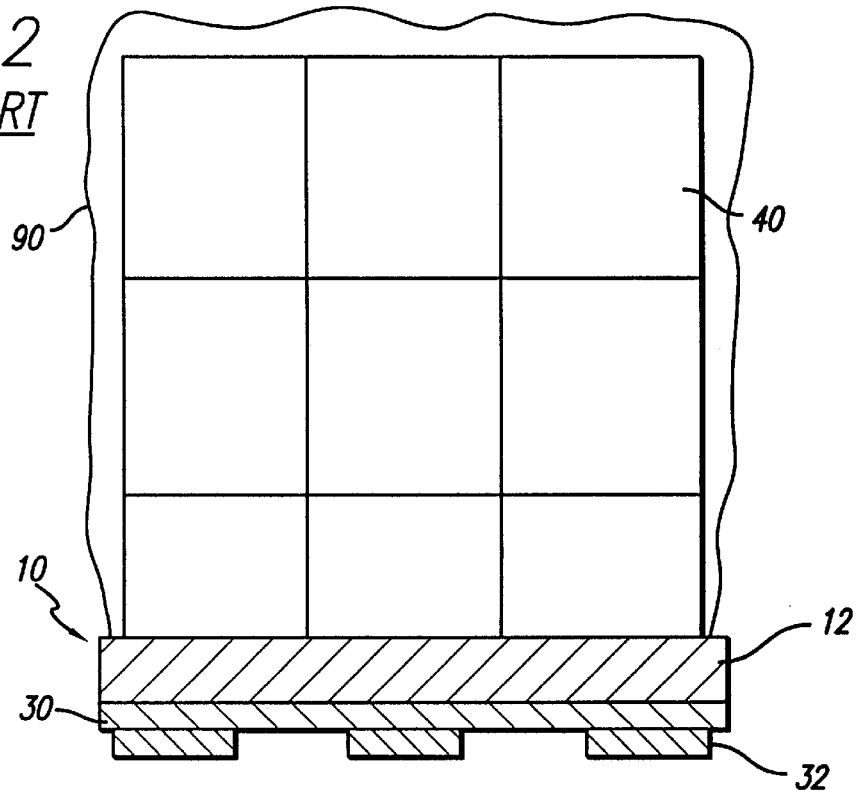
FIG. 2 PRIOR ART
FIG. 2 illustrates a prior art sealed enclosure created by a covering positioned over the goods and attached to the base cap of FIG. 1.
Figure 3:
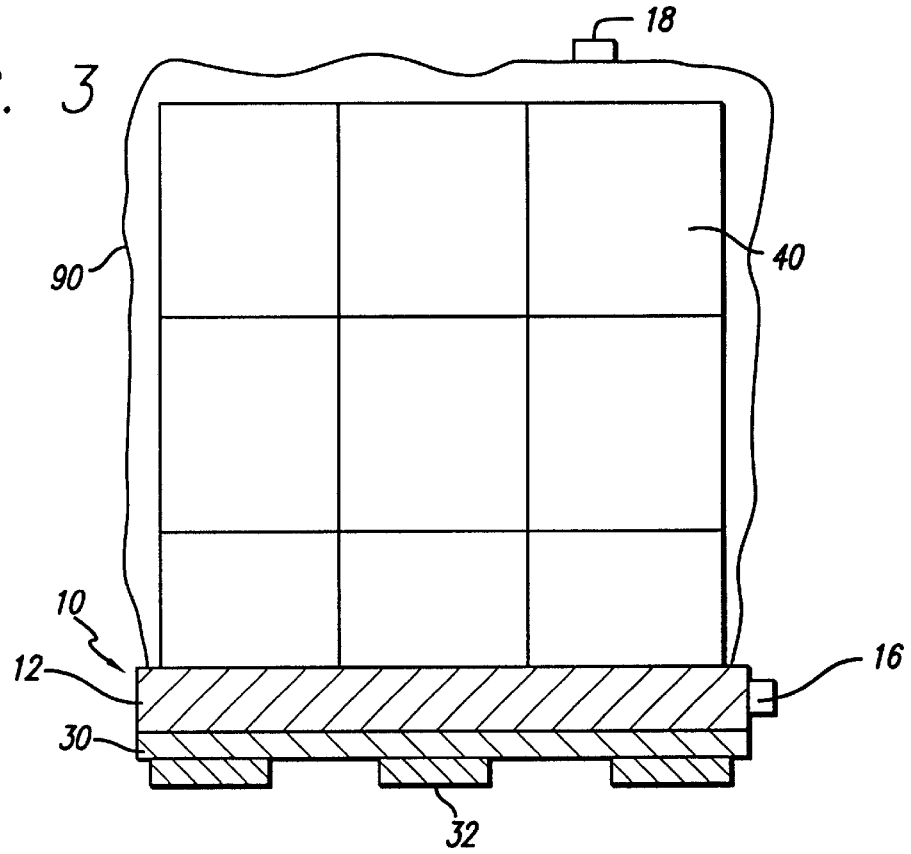
FIG. 3 illustrates a perspective view of a sealed enclosure formed by a base cap, a bag-like covering and at least one valve coupled to the base cap, in accordance with one embodiment of the invention. Optionally, at least one valve may be incorporated into the covering in addition to, or alternatively to, at least one valve coupled to the base cap.

FIG. 3 illustrates a side perspective view of one embodiment of the invention that includes a base cap 10 positioned on top of a pallet 30. As shown in FIG. 3, the pallet 30 typically includes lifters or pegs 32, which raise the bottom surface of the pallet 30 off the ground. This keeps the goods 40 away from contaminants that may be on the ground and further facilitates machinery, such as a forklift, to lift the pallet off the ground for transportation. The base cap 10 is typically rectangular or square in shape, to conform to the size and shape of a typical pallet, and includes four side flaps or walls 12 which extend upwardly from the four side edges of the rectangular-shaped base cap 10. The goods 40 are placed on top of the base cap 10 and at least a bottom portion of the goods 40 are surrounded by and retained within the four side walls 12 of the base cap 10. The sealed pallet assembly further includes a bag-like covering 90 which is placed over and around the goods 40 so as to form a sealed enclosure around the goods 40 in conjunction with the base cap 10. The covering 90 may be attached at its bottom edges to the base cap 10 by means of glue, tape or any technique that is known in the art to create, as near as possible, an airtight seal between the covering 90 and the base cap 10. Therefore, the goods 40 are enclosed in a sealed environment created by the covering 90 and the base cap 10.

FIG. 3 further illustrates a gas intake/outtake valve 16, coupled to a side wall 12 of the base cap 10, for allowing an appropriate coupling device attached to the end of a hose, for example, to mate with the valve 16. In this way, the valve 16 can receive a desired gas directed through the hose into the sealed enclosure or chamber. Additionally, the valve 16 may expel unwanted gas out of the sealed enclosure or allow samples of gas to travel to a sensor 140 (FIG. 11) for testing and monitoring purposes. The sensor 140 is described in further detail below with respect to FIG. 11.

Alternatively, or additionally, the sealed enclosure of the present invention may include a gas intake/outtake valve 18 coupled to the bag-like covering 90. In one embodiment, the valve 18 may be integrated into the covering 90 by any means known in the art. Similar to valve 16 described above, the valve 18 allows an appropriate coupling device to mate with valve 18 thereby allowing a desired gas, or combination of gases, to flow into and out of the sealed enclosure formed by the covering 90 and the base cap 10.

Each of the valves 16 and 18 may be any one of a number of well-known valves which can be opened and closed, either manually or automatically, to either start or stop the flow of gases or liquids into or out of the sealed enclosure. For example, the valves 16 and 18 may be threaded metal or plastic pipe ends which can be "closed" with a threaded cap and "opened" by mating with a threaded end of a hose. As another example, the valves 16 and 18 may be of the type that connect to the end of a hose used to provide carbonation from a carbonation tank to a soda dispensing machine found in most restaurants. In one embodiment, valves 16 and 18 are model no. PLC-12 "quick connector" valves, manufactured by Colder Products Company.

The base cap 10 functions as a barrier between the bottom surface of the goods 40 and the pallet 30 and functions to protect the goods 40 from contaminants and/or moisture present on the pallet or the ground. The base cap 10 can be made from any material such as coated paper, plastic, metal, wood, or coated fabric but is preferably relatively gas and liquid impermeable in order to prevent gases and/or moisture from entering or leaving the sealed enclosure from the bottom.

The base cap 10 is preferably sized and shaped to conform to the size and shape of the pallet 30. In one embodiment, the base cap 10 is rectangular-shaped to substantially conform to the rectangular shape of the pallet 30 on which it rests. The base cap 10 further includes four side flaps or walls 12 which each extend upwardly from a respective edge of the base cap 10 to cover and retain within their boundaries at least a bottom portion of the goods 40. The base cap 10 can be optionally shaped as needed for protection and transportation of any shape and/or size of goods 40 or pallet 30.

The covering 90 may be made from any desired material depending on the function desired to be performed. In one embodiment, the covering 90 may be semi-permeable to prevent contaminants from entering the enclosure but to allow some gases to escape from the sealed enclosure to prevent the build up of undesirable gases. In another embodiment, the covering 90 may be gas impermeable so as to prevent desired gases from escaping from the internal enclosure.

In another embodiment, covering 90 is sealed to the base cap 10 with adhesive stretch wrap or a heat-shrink wrap which is well-known in the industry. The stretch wrap or heat-shrink wrap encircles the goods 40 and the base cap 10. After heat is applied, the heat-shrink wrap reduces in size to tightly seal and secure the goods 40 and form a seal with the base cap 10.

Optionally, the covering 90 may also have insulating qualities. For example, "bubble wrapping" is a well-known technology that is an effective insulating material. The insulating covering may have other forms such as fiberglass mesh or other high tech fiber, various foam materials, plastic gels, cardboard liners, encasing bags, etc. The particular composition and form of the insulating covering is not limited in the present invention. The insulating covering may be used alone to cover the palletized good or may be layered with other coverings. The insulating covering can be applied like any other covering and helps preserve the goods 40 by preventing contact with external contaminates and/or changes in the atmosphere within the sealed enclosure.

Furthermore, the covering 90 may form an anti-pest barrier. The covering 90 may be treated with a chemical treatment such as an insecticide or an insect repellant. Alternatively, the covering 90 may have a screen-like quality to prevent pests from entering the sealed enclosure. The anti-insect covering may be used by itself or in combination with other coverings and/or wrappings.

Figure 4:
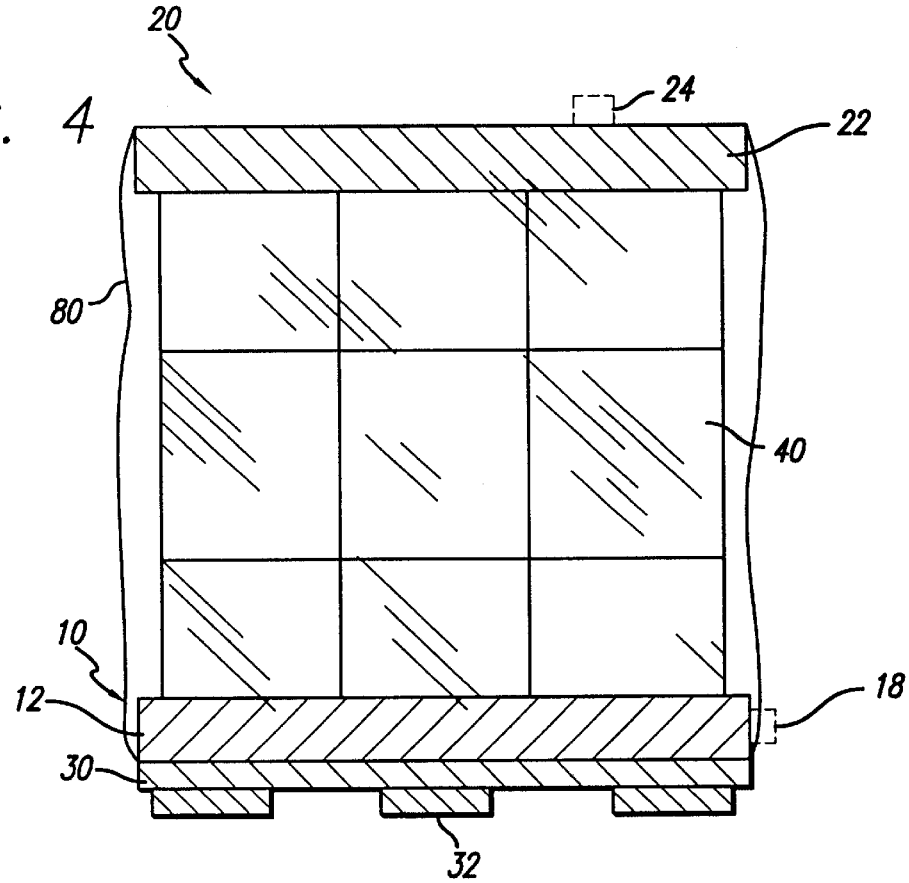
FIG. 4 illustrates a perspective view of a sealed enclosure formed by a base cap, a top cap and a side wrapping which adheres to the base and top caps in accordance with one embodiment of the invention.

Referring to FIG. 4, one embodiment of the invention includes a base cap 10 positioned on top of a pallet 30 and goods 40 placed on top of the base cap 10. As discussed with reference to FIG. 3, in one embodiment, the base cap 10 is rectangular-shaped to conform to the typical shape of a pallet and includes four side walls 12 which extend upwardly from the edges of the rectangular-shaped base cap 10 to surround and retain within their boundaries at least a bottom portion of the goods 40 after they have been placed on top of, and into, the base cap 10.

A top cap 20 is then placed over the upper surface of the goods 40 to create a top seal. To complete the enclosure, a side wrapping 80 is applied around the side surfaces of the goods. The side wrapping 80 overlaps the base cap 10 and the top cap 20 to create airtight seals at both intersections. Two methods of applying the side wrapping 80 around the top and base caps, 20 and 10, respectively, and the goods 40, are described in further detail below with reference to FIGS. 9 and 10.

The top cap 20 functions as a barrier placed over the top surface of the goods 40. The top cap 20 can be made from any material such as coated paper, plastic, metal, wood, or coated fabric but is preferably relatively gas and liquid impermeable in order to prevent gases and/or moisture from entering or leaving the sealed enclosure from the top. The top cap 20 is preferably shaped to cover the top surface of the upper-most goods 40. As shown in FIG. 4, in one embodiment, the top cap 20 is rectangular-shaped and includes four side flaps or walls 22 that extend downwardly from each of the four edges of the top cap 20 to cover at least a top portion of goods 40. The top cap 20 can be optionally shaped as needed for protection and transportation of any shape and/or size of goods. The combination of a top cap 20 on a loaded pallet 50 is referred to herein as a pallet assembly.

FIG. 4 further illustrates the wrapping 80 after it has been applied around caps 10 and 20 and over goods 40. The wrapping 80 overlaps the goods 40, the base cap 10, and the top cap 20 to create a sealed enclosure. The wrapping 80 may be made from any desired material depending on the function desired to be performed. In one embodiment, the wrapping 80 may be semi-permeable to prevent contaminants from entering the enclosure but to allow some gases to escape from the sealed enclosure to prevent the build up of undesirable gases. In another embodiment, the wrapping 80 may be gas impermeable so as to prevent desired gases from escaping from the internal enclosure.

In another embodiment, wrapping 80 is sealed with adhesive stretch wrap or a heat-shrink wrap which is well-known in the industry. The stretch wrap or heat-shrink wrap encircles the goods 40, base cap 10 and top cap 20. After heat is applied, the heat-shrink wrap reduces in size to tightly seal and secure the goods 40 between the base cap 10 and the top cap 20.

Optionally, the wrapping 80 may also have insulating qualities. For example, "bubble wrapping" is a well-known technology that is an effective insulating material. The wrapping may have other forms such as fiberglass mesh or other high tech fiber, various foam materials, plastic gels, cardboard liners, encasing bags, etc. The particular composition and form of the insulating wrapping is not limited in the present invention. The insulating wrapping may be used alone to cover the palletized good or may be layered with other wrappings or coverings. The insulating wrapping can be applied like any other wrapping and helps preserve the goods 40 by preventing contact with external contaminants and/or changes in the atmosphere within the sealed enclosure.

Furthermore, the wrapping 80 may form an anti-pest barrier. The wrapping 80 may be treated with a chemical treatment such as an insecticide or an insect repellant. Alternatively, the wrapping 80 may have a screen-like quality to prevent pests from entering the sealed enclosure. The anti-insect wrapping may be used by itself or in combination with other wrappings.

Figure 5:
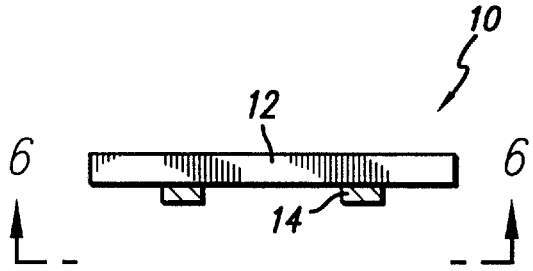
FIG. 5 illustrates a side view of the base cap of FIGS. 3 and 4 having tabs in accordance with one embodiment of the invention.
Figure 6:
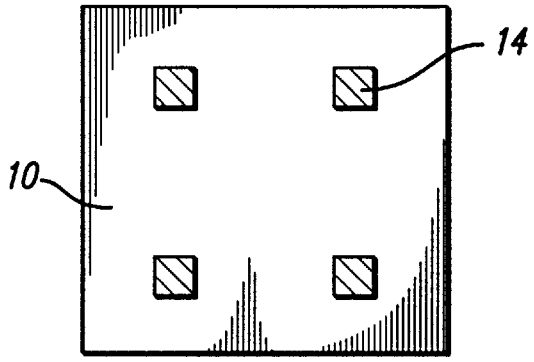
FIG. 6 illustrates a bottom view of the base cap with tabs of FIG. 5, taken from a perspective indicated by line 6—6 of that figure.
Figure 7:
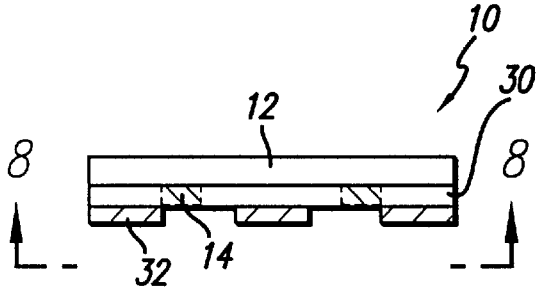
FIG. 7 illustrates a side view of the base cap with tabs of FIG. 5 positioned on a pallet.
Figure 8:
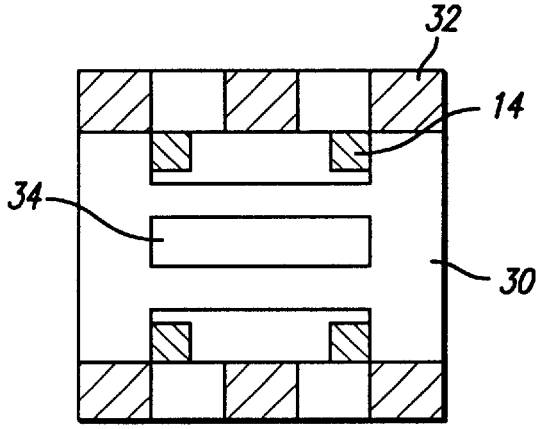
FIG. 8 illustrates a bottom view of the base cap of FIG. 7 positioned on a pallet, taken from a perspective indicated by line 8—8 of that figure.

In the present invention, the base cap 10 optionally includes tabs 14 sized to fit between slats typically found on the pallet 30. FIG. 5 illustrates a perspective side view of the base cap 10 having tabs 14 which help secure the base cap 10 to the pallet 30 by preventing the base cap 10 from moving or sliding around on the pallet 30. FIG. 6 illustrates a bottom view of the base cap 10 of FIG. 5, taken from a perspective along lines 6—6 of FIG. 5. In the embodiment shown, the base cap 10 includes four tabs 14 which extend outwardly from the bottom surface of the base cap 10. FIG. 7 illustrates how tabs 14 fit into the slats of pallet 30 to horizontally lock base cap 10 in position with respect to the pallet 30. The tabs 14 can be any size or material and are preferably integrally constructed to the base cap. As illustrated in FIG. 7, when the base cap 10 is positioned on top of the pallet 30, tabs 14 extend downwardly from the bottom surface of the base cap 10 and protrude into slats 34 (FIG. 8) of the pallet 30 so as to secure the base cap 10 to the pallet 30. FIG. 8 shows a bottom perspective view of FIG. 7 taken along lines 8—8 of that figure. The pallet includes legs 32, also known as lifters 32, and three slats 34. In the embodiment illustrated in FIG. 8, the tabs 14 of the base cap 10 fit into the external-corner regions of the two exterior slats to lock the base cap 10 into place with the pallet 30. In other embodiments, the number and size of tabs 14 and slats 34 may be varied depending on desired configurations.

Referring again to FIG. 4, although applying the wrapping 80 can be accomplished by a series of manually executed steps, automated machinery improves the speed and accuracy of the system application and provides significant economies of scale. The machine can either circle the wrapping 80 around the pallet assembly or, alternatively, the machine can rotate the pallet assembly near a dispenser of wrapping 80.

Figure 9:
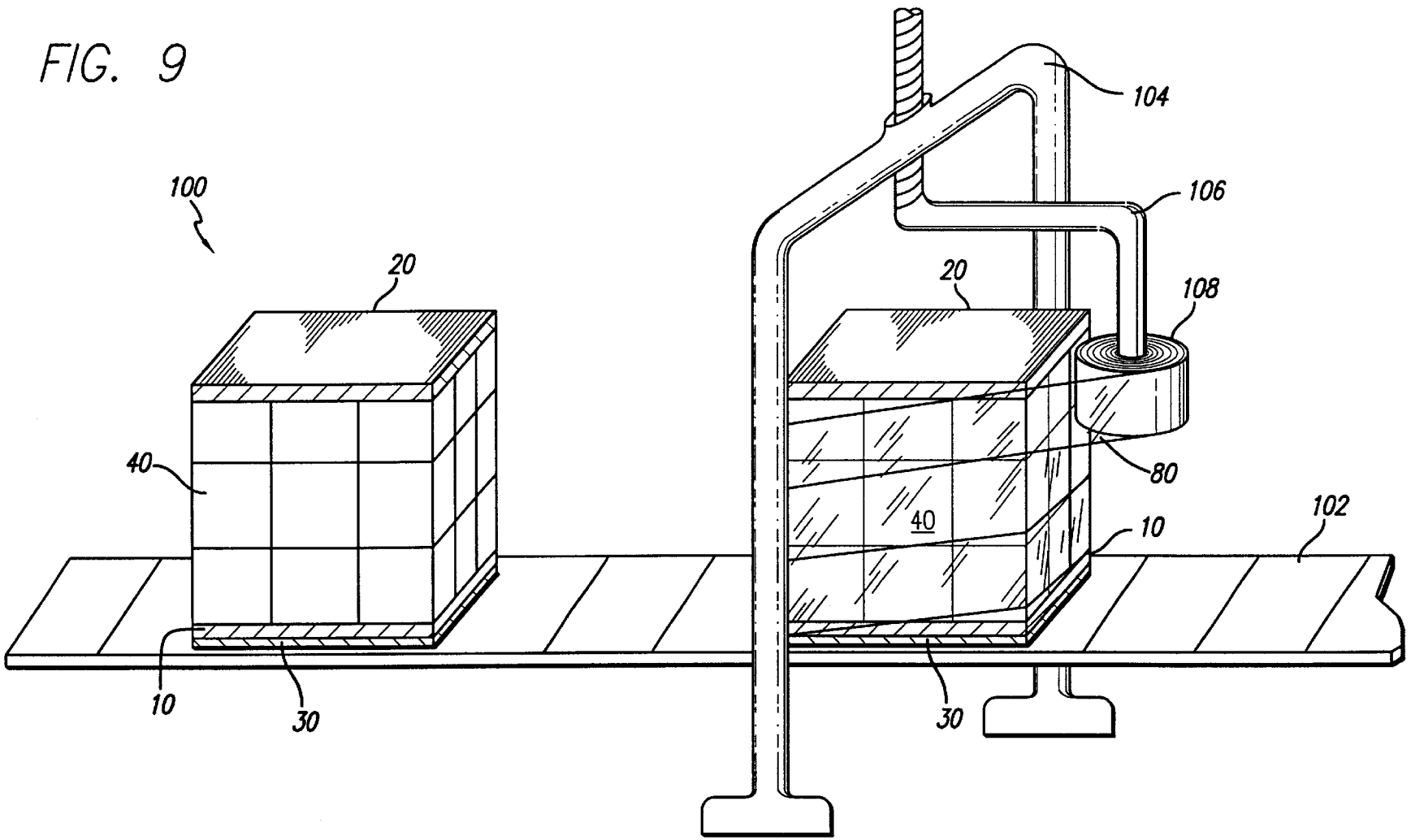
FIG. 9 illustrates a system for applying side wrapping around goods positioned between a base cap and a top cap, in accordance with one embodiment of the invention.

FIG. 9 illustrates an automated wrapping system 100 that revolves a roll 108 of wrapping 80 around the palletized goods 40, base cap 10 and top cap 20. The revolution of a revolving robotic arm 106 dispenses the wrapping 80 around the pallet assembly. Where the width of the wrapping 80 is not as tall as the pallet assembly, the wrapping needs to spiral so that the whole vertical surface of the side walls of the pallet assembly is sealed. To accomplish this spiraling, a support structure 104 and the revolving arm 106 preferably combine to create a device that vertically transposes the roll 108 of wrapping 80, coupled to the robotic arm 106, during application of wrapping 80. For example, revolving arm 106 may be threaded, causing the arm to move up or down during spinning. Alternatively, support 104 may have a hydraulic mechanism that raises or lowers the revolving arm 106 while it spins. Such hydraulic mechanisms are well-known in the art. The wrapping machine 100 may spiral the wrapping 80 automatically or the spiraling may be achieved manually by a person operating the machine. Such automatic or manual machines are also well-known in the art.

The wrapping system 100 further includes an optional conveyer belt 102 that transports the palletized goods to and from the wrapping location. Otherwise, the pallet assembly may be moved to and from the wrapping location by another method such as by forklift, for example. The support 104 holds the revolving arm 106 that holds the roll of wrapping 80. The revolving arm 106, in one embodiment, is coupled to a motor that turns the revolving arm 106 around the palletized goods. In another embodiment, the arm 106 can be turned manually.

Figure 10:
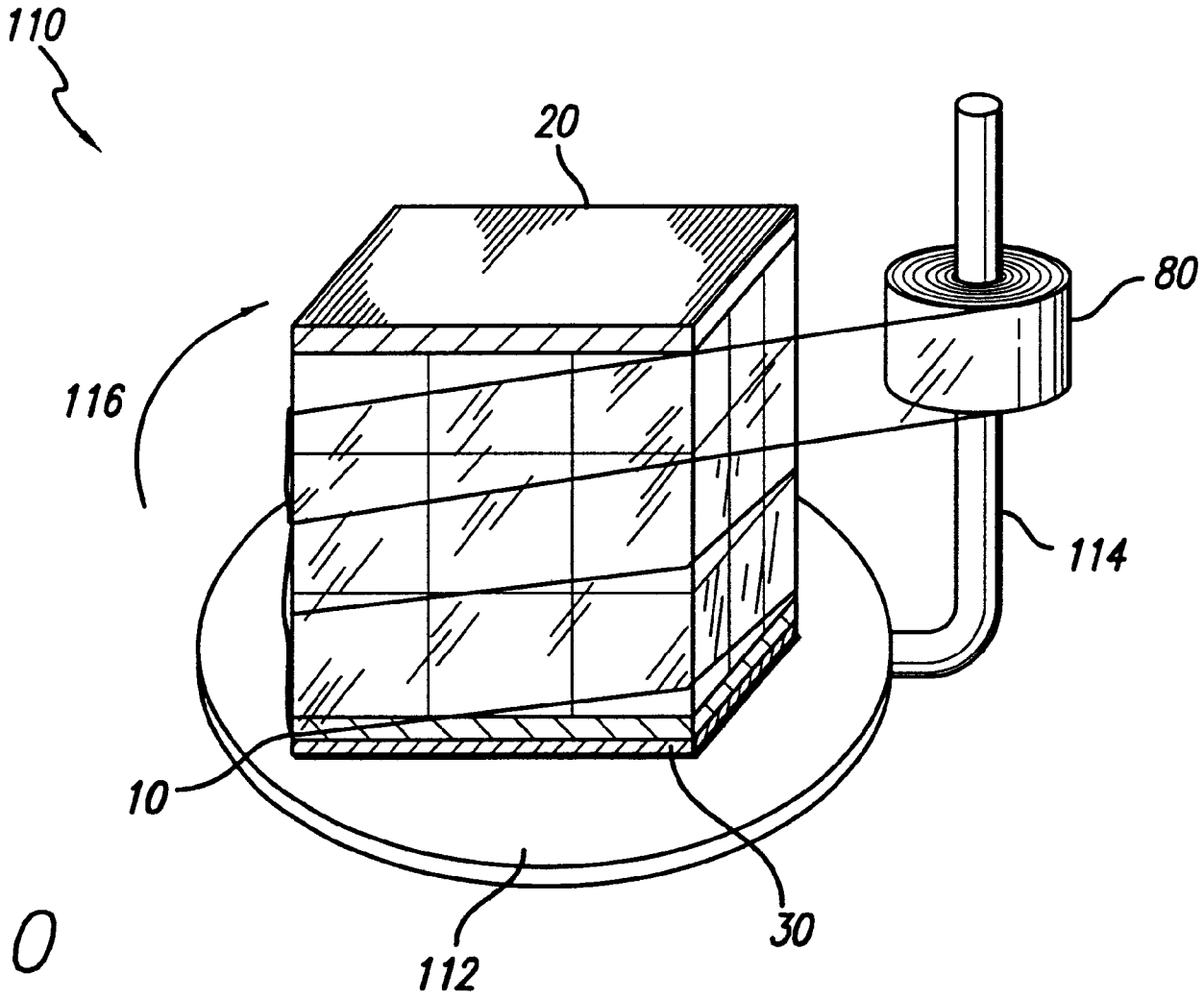
FIG. 10 illustrates another system for applying wrapping to the palletized goods, in accordance with another embodiment of the invention.

FIG. 10 shows a wrapping machine 110 that rotates the pallet assembly near a wrapping dispenser 114 in accordance with another embodiment of the invention. The wrapping machine 110 has a rotating platform 112 that spins the pallet assembly, in a direction indicated by arrow 116, for example, near the dispensing arm 114. The pallet assembly can be placed on the rotating platform 112 by a forklift, robotic arm or other mechanical device. Alternatively, the pallet assembly can be formed directly on the platform 112. The platform may be rotated either manually or automatically by a motor.

As previously discussed, if the width of the wrapping is less than the height of the loaded pallet assembly, there is a need to vertically transpose the wrapping 80. Preferably, the platform 112 and the dispensing arm 114 combine to form a mechanism that vertically moves a roll of wrapping 80, coupled to the dispensing arm 114, relative to the palletized goods 40 so as to spiral the wrapping 80 around the surfaces of the sealed enclosure. For example, dispensing arm 114 may be threaded to force the wrapping 80 to rise or fall at a desired rate as wrapping 80 is applied.

Figure 11:
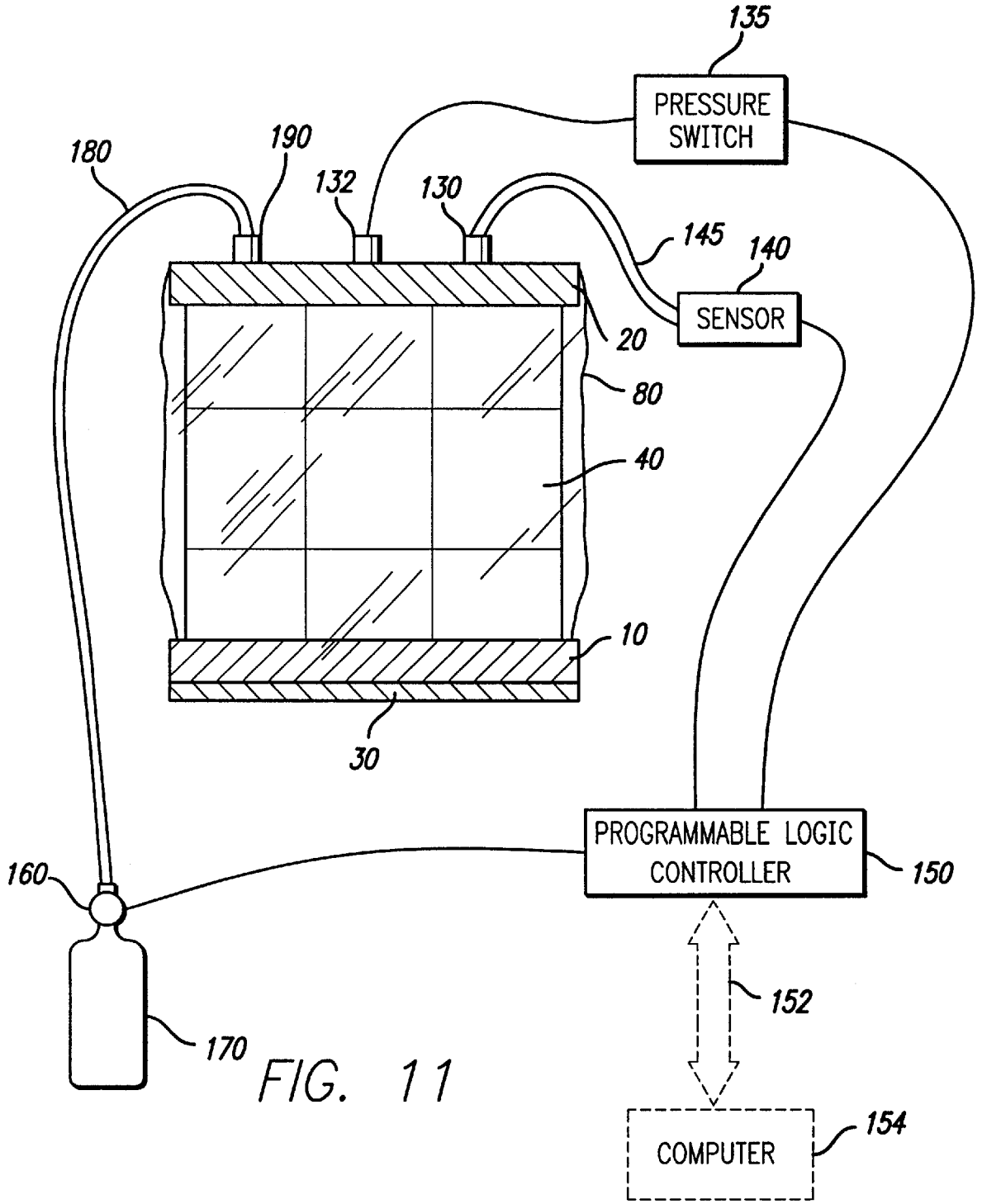
FIG. 11 illustrates a sensor, a pressure switch, a controller and a gas tank coupled to a sealed enclosure, in accordance with one embodiment of the invention. Optionally, a computer is coupled to the controller.

After a sealed enclosure has been formed by one of the methods described above, the present invention further includes a method to establish and, optionally, maintain a modified atmosphere within the sealed enclosure during storage or transportation of the palletized goods. FIG. 11 illustrates one embodiment of a method and system for establishing, and optionally maintaining a controlled environment within the sealed enclosure. The system includes a sensor 140 which can receive samples of gas from the sealed enclosure via a hose 145 coupled to a valve 130 located on the top cap 20. The sensor 140 may be any one of a number of well-known sensors which can sense or measure a desired parameter such as, for example, temperature, concentration levels, humidity, pressure, chemical composition, etc. After the sensor 140 analyzes a gas sample, for example, it processes the information and converts the information into a predetermined data format. This data is then transmitted to a controller 150 for further processing.

In one embodiment, the controller 150 is a programmable logic controller (PLC) 150 which receives data from the sensor 140 and thereafter implements some sort of corrective or responsive action. As shown in FIG. 11, the controller 150 is coupled to an automated valve 160 which is in turn coupled to a gas tank 170. When valve 160 is in an open state, it allows gas from tank 170 to flow through the hose 180 into the sealed enclosure via a second valve 190 coupled to the top cap 20. The controller 150 regulates the flow of a desired gas from the gas tank 170 into the sealed enclosure by either opening or closing the valve 160 in response to data received from the sensor 140. In alternate embodiments, the valve 190 may be of a type capable of being opened and closed automatically and the controller may be coupled directly to valve 190, thereby directly controlling the operation of valve 190 to regulate the flow of one or more gases into the sealed enclosure.

The system of FIG. 11 further includes a third value 132, coupled to the top cap 20, for evacuating the internal area surrounded by the sealed enclosure. Typically, an evacuation process is carried out prior to injection of a desired gas from an external gas source, e.g., gas tank 170, into the sealed enclosure. A pressure switch 135, coupled to the third valve 132 measures the atmospheric pressure within the sealed enclosure during the evacuation process to ensure that the sealed enclosure has been sufficiently evacuated before the pressurized flow of gas from the external gas source can enter the sealed enclosure via hose 180 and second valve 190. The pressure switch 135 is coupled to the controller 150 and sends a signal to the controller 150 once a sufficient vacuum is created by the evacuation process. Thereafter, the controller 150 can operate the automated valve 160 and/or valve 190 to begin the pressurized flow of gas, otherwise referred to herein as "injection," into the sealed enclosure.

FIG. 11 further illustrates an optional computer 154 which is linked to the controller 150 via a communications link 152. The computer 154 may be a standard personal computer which is well-known in the art and can be used to program the controller 150 with target parameters, set-points and/or operating instructions so that the controller implements a desired protocol for providing monitoring functions and maintaining a desired atmosphere within the sealed enclosure. The computer 152 may be just one of many computers, or servers, connected together in a local area network (LAN), or a wide area network (WAN), or the internet for example. The internet, and the LAN and WAN networks are well-known technologies and need not be further described herein. By providing connectivity through a computer network, such as the internet, for example, users located at remote computer terminals have the capability of accessing data stored in the controller 150 and/or computer 154, sending commands or instructions to the controller 150, and monitoring the atmosphere within the sealed enclosure.

The communications link 152 can be any type of standard link such as, for example, an ISDN communications line. Alternatively, the communications link 152 may be a wireless link such as an analog or digital communications link. Such analog and digital wireless communication techniques are well-known in the art. By providing a wireless link 152, a user located at the computer 154 can monitor and send instructions to the controller 150 while the rest of the structures illustrated in FIG. 11 are being transported to a location away from the computer 154.

The particular desired atmospheric mixture of gases to be monitored by the controller 150, as described above, depends on the needs of the goods. Preferably, a person can program this desired mixture into the controller 150. Achieving the correct atmosphere is important because it can substantially increase the longevity of many goods. The proper initial modified atmosphere charge, along with the proper film (barrier or semi-permeable), can provide a high degree of atmospheric regulation or maintenance capability, as well as atmospheric consistency within the enclosed pallet of product(s). The gaseous mix may also include ozone or other sanitizing treatments either individually, in sequence, or in various combinations to kill pathogens without harming the product. The particular gas mixtures are well known and need not be further discussed herein.

Each of the valves 130 and 190 is preferably a part that is integrally connected to the top cap 20 to permit access to the sealed enclosure. In one embodiment, each of the valves 130 and 190 is a "quick connector" made of plastic, rubber or another similar material which allows hoses to be snapped on and off the sealed enclosure. Quick connectors are a well-known technology. For example, model PLC-12 quick connectors manufactured by Colder Products Company may be used. The valves 130 and 190 may be integral parts of the base cap 10 or the top cap 20. Alternatively, the valves 130 and 190 may be attached to any part of the bag-like covering 90 (FIG. 3) or wrapping 80 (FIG. 4). In such a system, a hole is cut into the bag 90 or wrapping 80. Then the valves 130 and 190 are attached to the hole with glue, tape, heating or any other method known in the art.

The automated valve 160 and the third valve 135 may be any one of a number of well-known valves which may be automatically controlled and operated by a controller such as a programmable logic controller. Additionally, any one or all of the valves 130, 135 and 190 may, alternatively, be coupled to the base cap 10 rather than the top cap 20.

Figure 12:
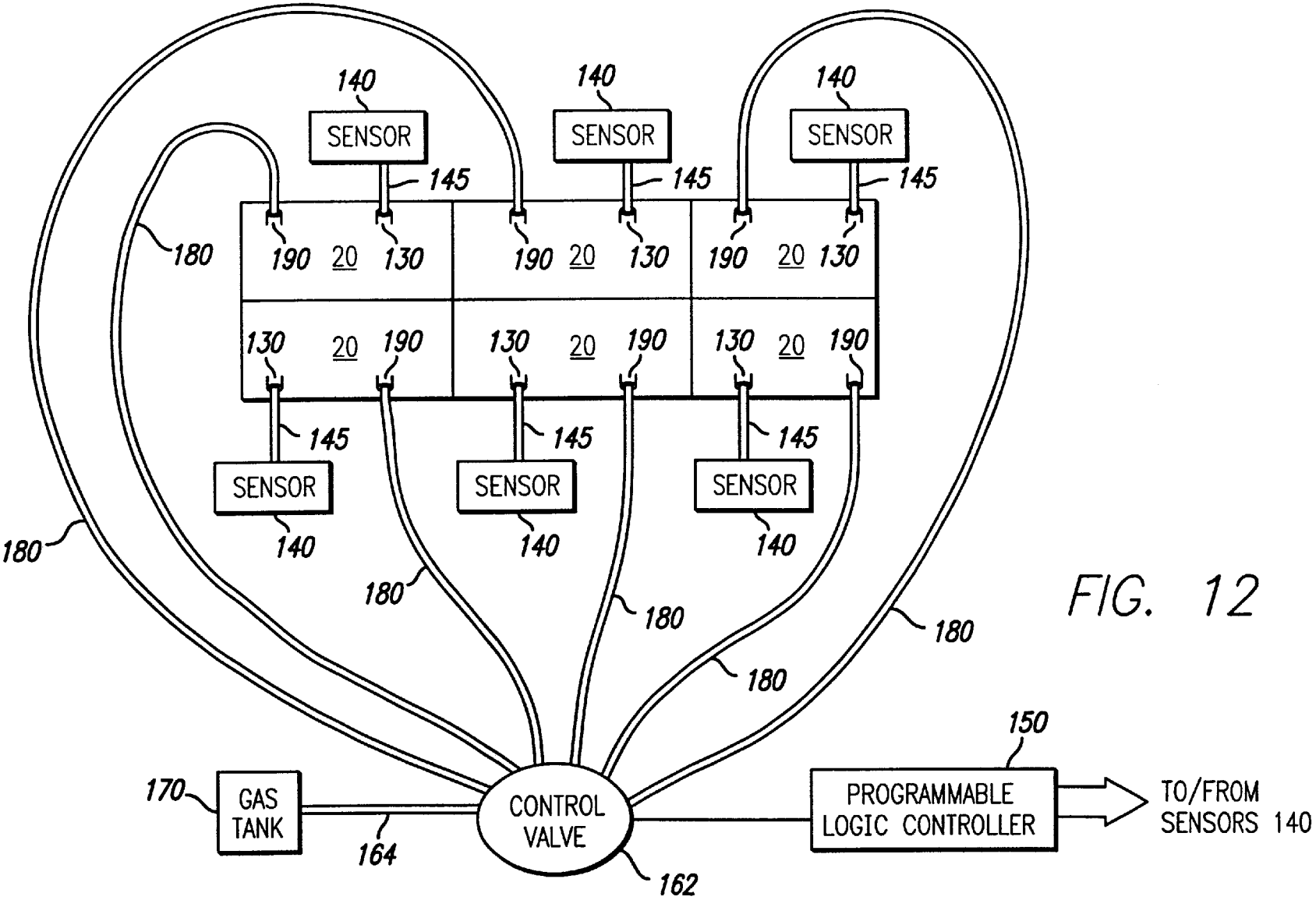
FIG. 12 illustrates multiple sealed enclosures (or other commercial transport or storage units) being monitored and/or controlled by multiple sensors, at least one gas tank and at least one controller, in accordance with one embodiment of the invention.

FIG. 12 illustrates a top perspective view of multiple sealed enclosures in an array being monitored by a single controller 150. For each sealed enclosure, a sensor 140 is coupled, via hose 145, to a valve 130 which is in turn coupled to the top cap 20 of each sealed enclosure. In the embodiment shown in FIG. 12, each sensor 140 is electronically coupled to the controller 150 and periodically transmits data to the controller 150 in accordance with a protocol programmed into the controller 150. Based on the data received from each of the sensors 140, the controller 150 controls the operation of the tank valve 162. In one embodiment, valve 162 is an automatic valve with one input port and multiple output ports which may be automatically controlled by command signals received from the controller 150. The controller 150 can initiate the flow of a particular gas, or atmosphere, from the gas tank 170 into select sealed enclosures by opening select output ports of the valve 162, thereby allowing the desired atmosphere to flow from the gas tank 170 through a respective hose 180 and into the select sealed enclosure via respective valves 190. It is understood that the particular system configuration shown in FIG. 12 is only one of many possible configurations in accordance with the invention. For example, multiple types of sensors 140 may be utilized to monitor multiple parameters, multiple gas tanks may be employed, and valve 162 may be replaced with multiple individual valves each coupled to a respective sealed enclosure.

Figure 13:
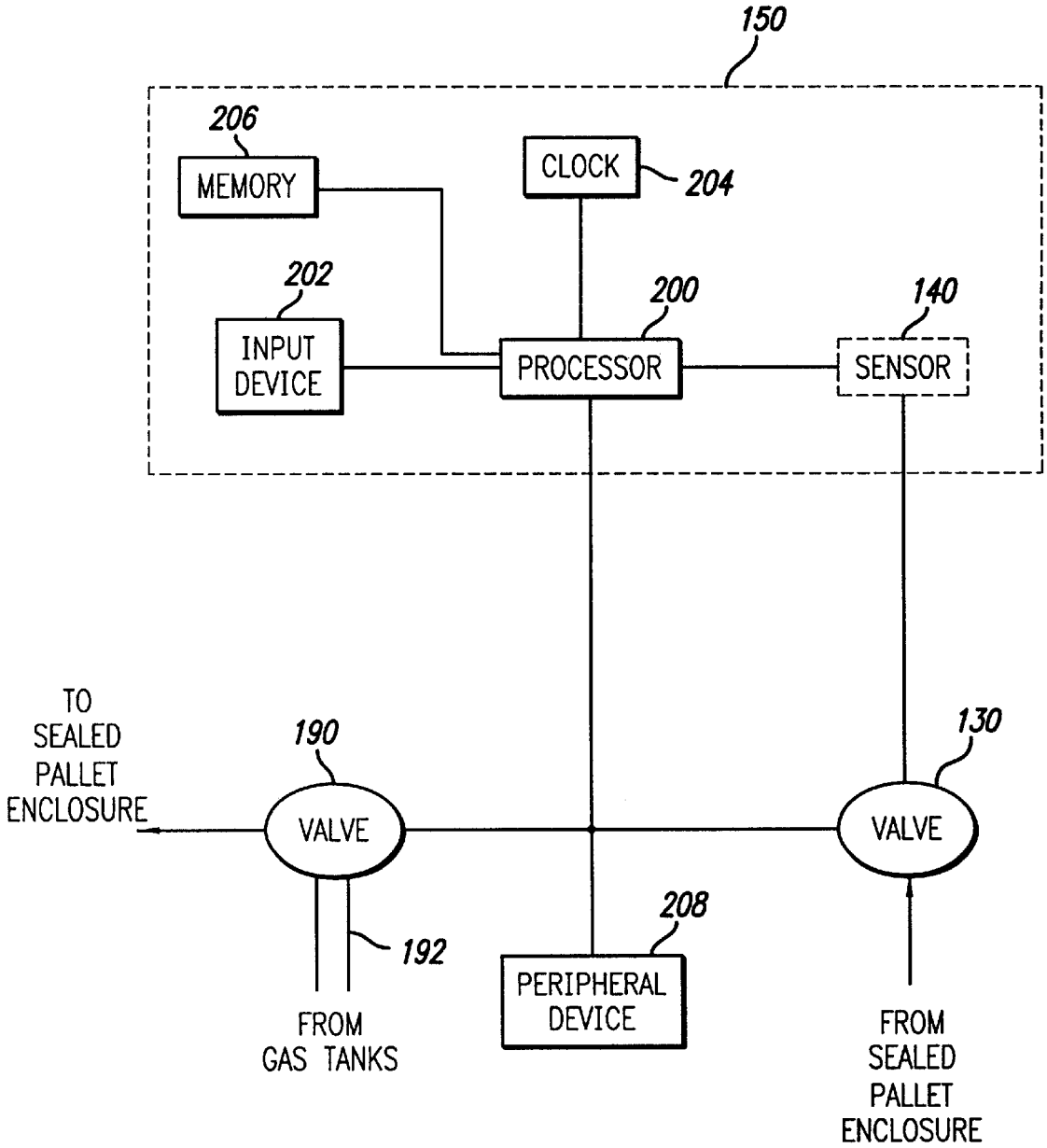
FIG. 13 illustrates a block diagram of some of the components of a controller in accordance with one embodiment of the invention.

FIG. 13 illustrates a block diagram of one embodiment of the controller 150. The controller 150 includes a processor 200 which is programmed by input device 202 coupled to the processor 200. The input device 202 may be an integral part of the controller 150, as shown in FIG. 13, or alternatively, may be an external peripheral device electronically coupled to the processor 200. In one embodiment, the input device 202 may be a computer and keyboard which can receive high-level instructions from a user, compile such instructions into a desired data format, and thereafter program the processor 200. However, any well-known method and device may be used to program the processor 200. The processor 200 receives information from sensor 140 and clock 204 and sends out instructions to valves 130 and 190 (FIG. 11), for example. Note that in contrast to the embodiment shown in FIG. 11, in the embodiment shown in FIG. 13, the sensor 140 is integrated into the controller 150, rather than being a separate device and the controller 150 is directly coupled to the valves 130 and 190 which are coupled to the top cap 20 (FIG. 11). Valve 190 connects to hose 192 from one or more gas tanks and allows gas to flow into the sealed enclosure. Valve 130 allows gas to flow from the sealed enclosure to the sensor 140. Clock 204 and input device 202 are optional components of the controller 150.

The logic processor 200 can be any device designed to receive and process information. In one embodiment, the processor 200 is a standard laptop computer which can be programmed, updated, and/or reprogrammed at will, even via the internet. The processor 200 makes choices based upon instructions built into the processor or programmed by a human operator. The processor 200 receives instructions from the input device 202, which may be a standard computer keyboard, for example. The processor 200 further receives information from the sensor 140 and clock 204. In another embodiment, the processor 200 may be a type of mass-produced, transistor-based microprocessor such as a processor chip. These types of devices are well-known and are readily and commercially available.

The input device 202 allows the human operator to alter the decisions made by the logic processor 200. In this way the controller can be adjusted to meet the needs of different goods. As discussed above, the input device 202 may be any one of various well-known input devices such as a computer keyboard, a phone line, or a disk drive capable of programming the processor 200.

The clock 204 can be any time keeping unit which is well-known in the art. Commonly, the clock 204 is a digital timer on the logic processor 200 that emits an intermittent time signal. Alternatively, the clock 204 may be any time-keeping signal from an outside source. The clock 204 permits the processor 200 to make decisions based on time.

The sensor 140 receives gas or atmosphere samples from the sealed enclosure and detects certain qualities. Such sensors are well-known in the art and are readily commercially available. The type of sensor 140 may vary depending on the qualities to be measured. For example, the sensor 140 can contain a thermometer to determine air temperature. The sensor 140 may also contain a barometer to test for air pressure. Preferably, the sensor 140 contains various chemical detectors to determine the composition of the gases introduced into the sealed enclosure. Such sensors are well known and, therefore, will not be further described here. In the embodiment illustrated in FIG. 13, the sensor 140 in the controller 150 converts the results to digital signals that are sent to the logic processor 200. A memory 206, coupled to the processor 200, stores the data received from the sensor 140 for subsequent processing and/or analysis.

The processor 200 responds to information inputs from the clock 204 and the sensor 140 by sending digital commands to open and close the valves 130 and 190. In one embodiment, the valves 130 and 190 may control gas flow in and out of the sealed enclosure respectively. Digitally and electronically controlled valves are well known. In one embodiment, the processor 200 is also coupled to a peripheral device 208 which may be any one of a number of devices and/or circuits known in the art. In one embodiment, the peripheral device 208 may be the computer 154 (FIG. 11) connected to the processor 200 via link 152 (FIG. 11). In another embodiment, the peripheral device may be a circuit for generating an audio and/or visual alarm if data received from the sensor 140 indicates that an atmospheric parameter is not within a predetermined range of a target parameter programmed into the processor 200. Such circuits for generating an audio and/or visual alarm are well-known in the art. Alternatively, the audio and/or visual alarm can be generated by the computer 154 (FIG. 11) by sending an alarm signal from the processor 200 to the computer 154 via the communications line 152 (FIG. 11).

Figure 14:
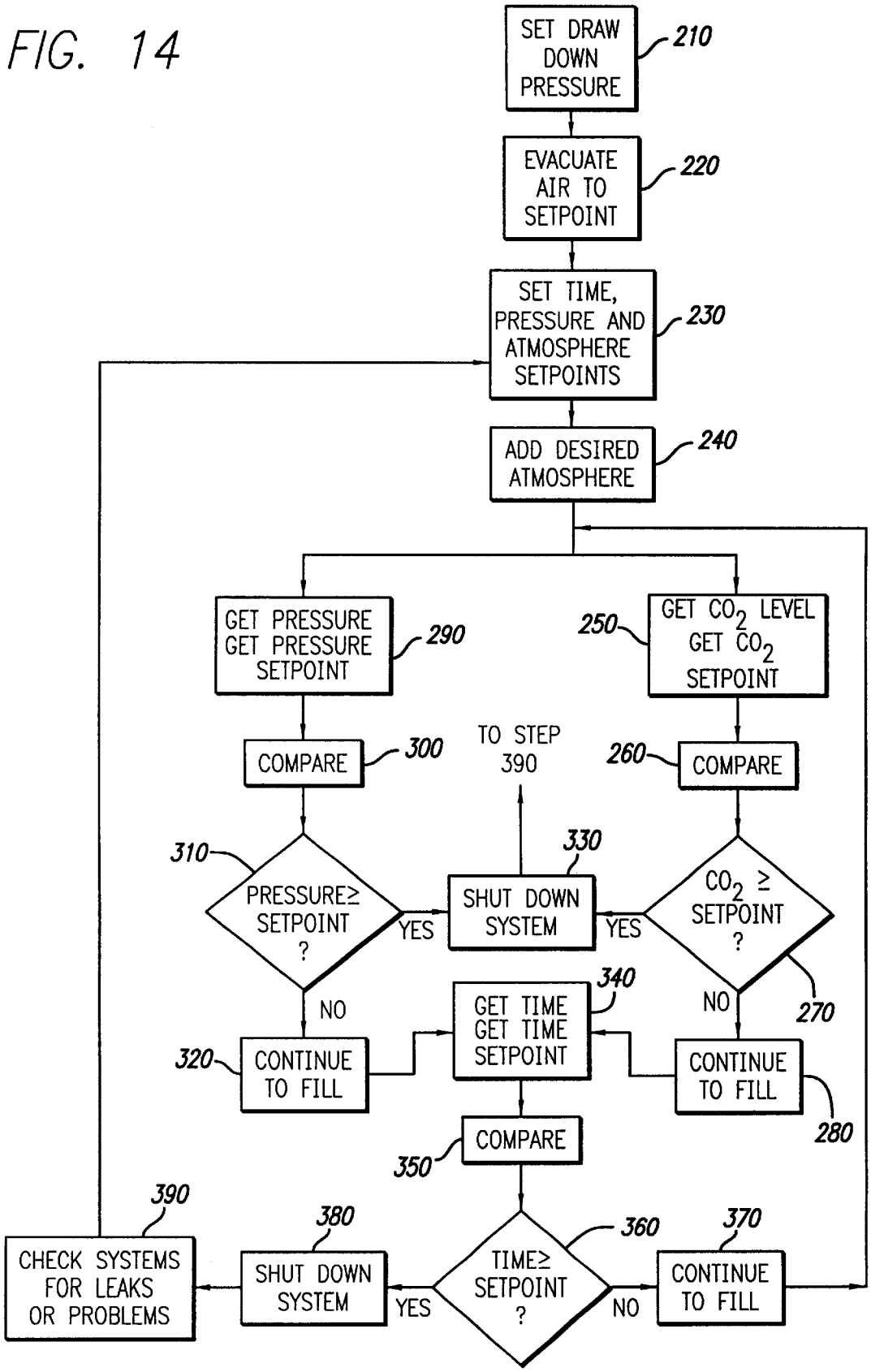
FIG. 14 is a flowchart illustrating some steps of a modified atmosphere process in accordance with one embodiment of the invention.

In one embodiment, the controller 150 is a modified atmosphere ("MA") controller that samples and introduces gases into the sealed enclosure until the desired atmosphere is achieved. After the desired atmosphere is achieved, the MA controller is removed and the sealed enclosure is resealed and transported or stored. A flowchart illustrating the operation of one type of an MA controller, in accordance with one embodiment of the invention, is shown in FIG. 14. This MA controller fills the sealed enclosure with $CO_2$ until desired levels of air pressure and $CO_2$ are achieved or the injection process runs out of time.

In steps 210 and 230, a person enters conditions into the MA controller. As previously discussed, these settings can be programmed into the processor by anyone of numerous input devices and/or methods. The drawdown pressure setting, step 210, defines the amount of air to be removed from the sealed enclosure.

In step 220, air is removed from the sealed enclosure until a sufficiently low pressure or drawdown setpoint is achieved. After the controller receives the new desired conditions in step 230, the controller opens valves to the gas tanks containing the desired gases. The opening of the valves is the beginning of step 240 in which the desired atmosphere is introduced into the sealed enclosure. A sensor 140 (FIGS. 11 and 13) then begins to monitor the atmospheric conditions within the sealed enclosure by sampling the enclosed atmosphere. In steps 250 and 290, the sensor measures the air pressure and the $CO_2$ levels and the measurements are compared to desired levels in steps 260 and 300. If desired levels are achieved, conditions 270 and 310 are satisfied and shutdown, step 330, is triggered. If either or both conditions are not satisfied, the steps 280 and/or 320 occurs and the controller continues to fill the sealed enclosure.

In step 340 the elapsed time is determined, and in 350 the elapsed time is compared to the desired time limit. If elapsed time has not yet exceeded the programmed time limit, condition 360 fails and the sealed enclosure continues to fill. If the programmed time limit is exceeded, then condition 360 is satisfied and step 380, shutdown, occurs.

After shutdown by either step 330 or 380, in step 390 a check for system leaks or problems is performed. If there are leaks or other problems, in step 390 the human operator fixes the problem and the process returns to step 230 where desired time, pressure, and atmospheric setpoints are reset.

In another embodiment, a controlled atmosphere ("CA") controller establishes the desired atmosphere within the sealed enclosure, and then continues to sample and adjust the atmosphere during transportation. Generally, the CA controller will maintain the desired atmosphere conditions, but the controller can optionally be programmed to adjust the atmosphere during transport or refrigerated storage. For example, the atmosphere can be adjusted, as previously discussed, to allow fruits to ripen as they near market. The controller may also optionally be programmed to fumigate the sealed enclosure during transport. The controller may intermittently add sanitizers or even toxic gases to kill pathogens in the sealed enclosure, but allow the toxic gases to be evacuated or dissipated before reaching the end of transport or controlled storage consumer.

Figure 15:
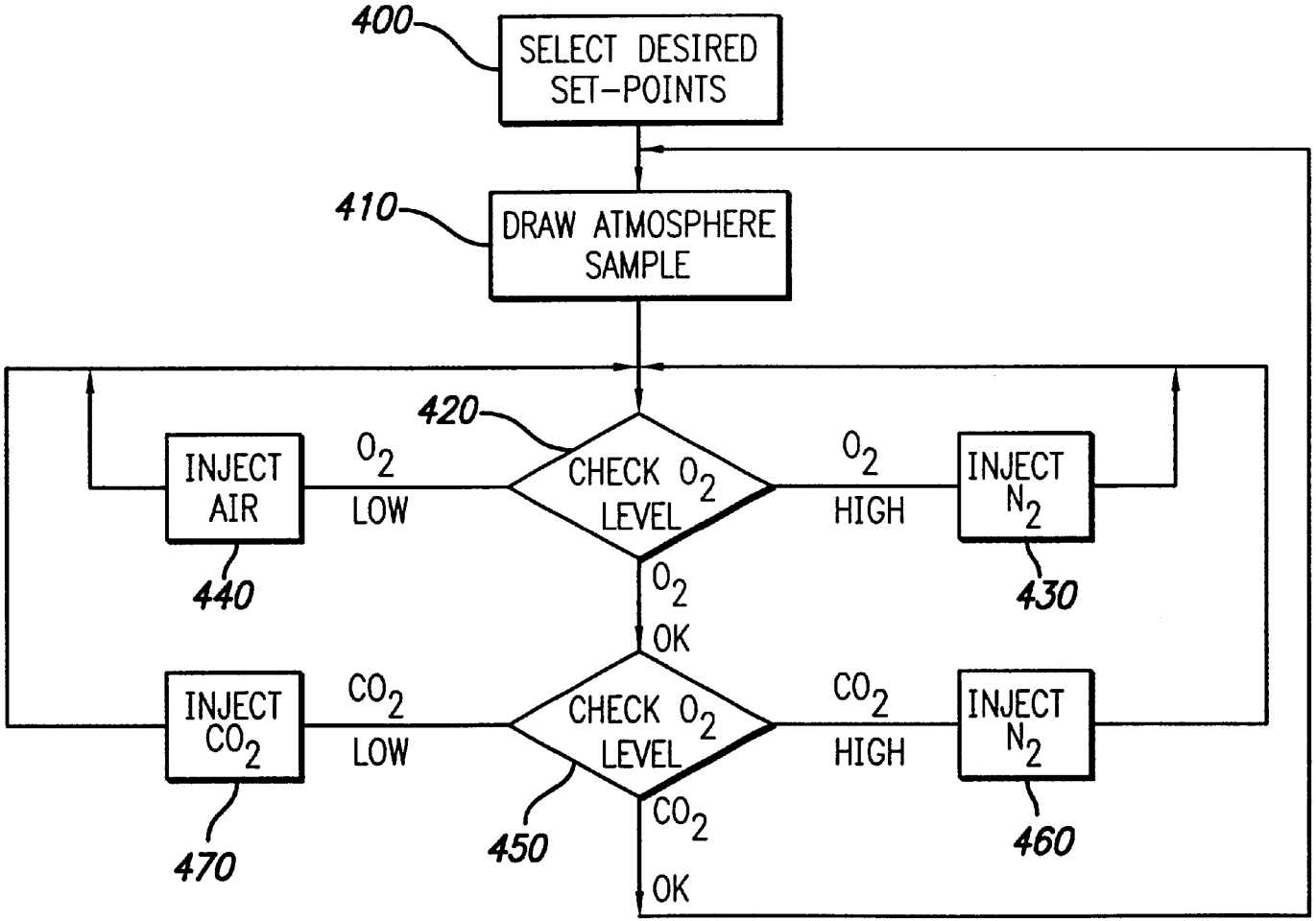
FIG. 15 is a flowchart illustrating some steps of a controlled atmosphere process which first checks for oxygen content, then for carbon dioxide content in accordance with one embodiment of the invention.

The operation or process of a CA controller, in accordance with one embodiment of the invention, is summarized in the flowchart of FIG. 15. The desired conditions or setpoints are selected in step 400. The controller takes an atmosphere sample from the sealed enclosure in step 410. In step 420, the controller compares the levels of $O_2$ to the setpoints selected during step 400. If the $O_2$ levels are low, the controller performs step 440 in which ambient air is added to the sealed enclosure. Conversely, if $O_2$ levels are too high, in step 430 the controller adds $N_2$ to the sealed enclosure. Once the desired levels of $O_2$ are achieved, in step 450, the controller next checks the $CO_2$ levels. If the $CO_2$ levels are low, in step 470 the controller adds $CO_2$ to the sealed enclosure. If $CO_2$ are too high, in step 460 the controller adds $N_2$ to the sealed enclosure. After either step 460 or step 470, the process repeats step 420 in which the controller returns to checking the $O_2$ levels. If the controller measures acceptable levels of both $O_2$ and $CO_2$, the controller returns to step 410 to draw a new air sample to test. The process may continue in time sequence for a predetermined length of time or indefinitely until the controller is removed from the sealed enclosure connection.

Figure 16:
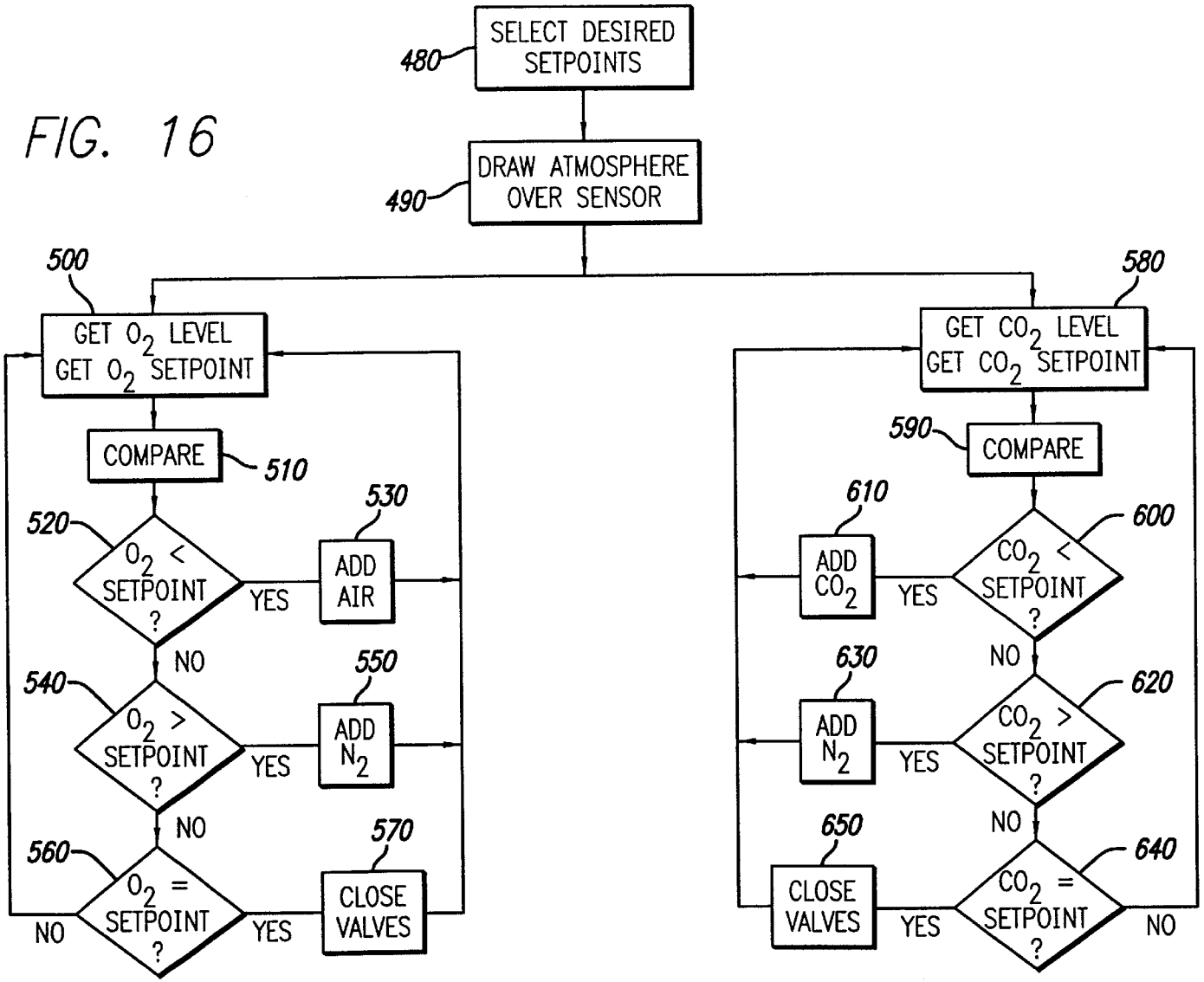
FIG. 16 is a flowchart illustrating some steps of a controlled atmosphere process which simultaneously checks oxygen and carbon dioxide content in accordance with one embodiment of the invention.

The operation or process performed by a CA controller in accordance with another embodiment of the invention is summarized in the flowchart of FIG. 16. The desired conditions or setpoints are selected in step 480. In step 490, the controller takes an atmosphere sample from the sealed enclosure by drawing the enclosed gases over the sensor. In step 500, the controller determines $O_2$ levels and, in step 510, compares the levels of $O_2$ to the setpoints selected during step 480. If $O_2$ levels are low, then condition 520 is true, and step 530 occurs. In step 530, the controller opens a valve to add ambient air to the sealed enclosure. If $O_2$ levels are too high, condition 540 is true, and the controller responds in step 550 by adding $N_2$ to the sealed enclosure. Once the desired level of $O_2$ are achieved condition 560 is true, and the controller performs step 570 by closing air valves coupled to the sealed enclosure, thereby preventing the flow of any gases to/from the interior of the enclosure.

While monitoring and maintaining the $O_2$ levels, the controller simultaneously checks and adjusts $CO_2$ levels. In step 580, the controller determines the levels of $CO_2$ and in step 590 the controller compares the measured levels of $CO_2$ levels to desired setpoints. If $CO_2$ levels are low, condition 600 is true, and in step 610, the controller opens the valve to $CO_2$ tanks for a predetermined amount of time and, thereafter, returns to step 580 to determine the level of $CO_2$. If the $CO_2$ levels are high, condition 620 is true, and in step 630 the controller opens the valves to the $N_2$ tanks (or source) to allow $N_2$ to enter the sealed enclosure. Once desired levels of $CO_2$ are achieved, condition 640 is satisfied, in step 650 the controller closes valves to the $CO_2$ tanks and $N_2$ tanks (or sources).

Figure 17:
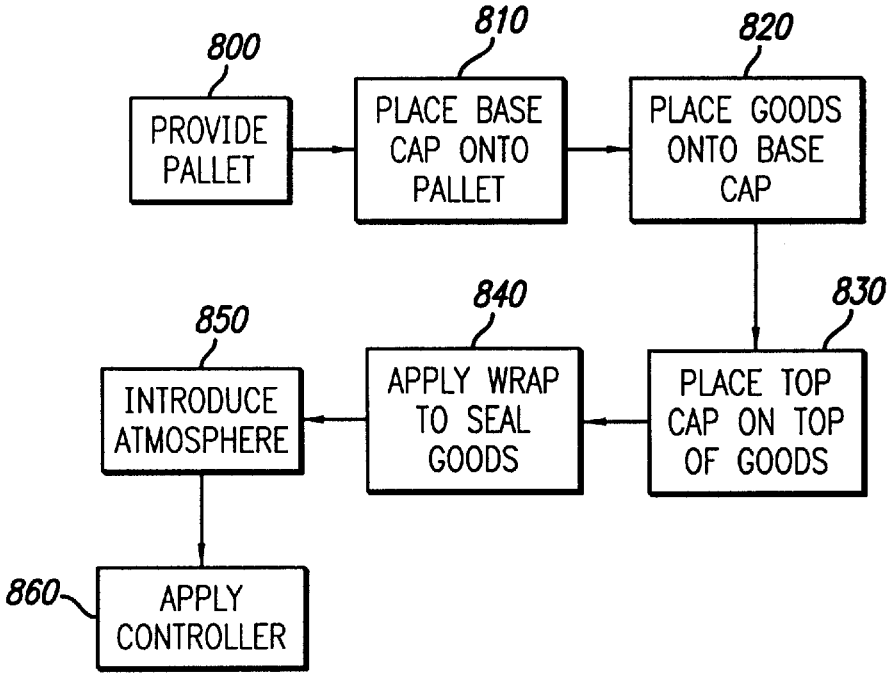
FIG. 17 is a flowchart of a method used to create and maintain a sealed enclosure with a top and base cap and a side wrapping in accordance with one embodiment of the invention.

A method for creating a sealed enclosure around perishable agricultural products or other products stacked on pallets, and for establishing and maintaining a modified atmosphere within the sealed pallet or bin enclosure is provided. An exemplary process includes the following steps, as illustrated and described in FIG. 17.

Step 800: Provide pallet The pallet can be positioned manually. Alternatively, the pallet can be positioned mechanically by a machine such as a forklift or mechanical arm.

Step 810: Put base cap on the pallet. The base cap can be positioned manually or by a machine such as a forklift or mechanical arm. FIG. 3 illustrates the base cap 10 positioned on the pallet 30. The base cap may be:

a) placed on the pallet (later weighted by the goods and secured by the wrapping of plastic film);

b) glued, taped or secured to the pallet; and/or c) may be constructed with bottom locking tabs 14 (FIGS. 5–8) to fit securely between the boards of the pallet to prevent the base cap from moving during transit. FIG. 4 shows a base cap with side flaps 12 which retain a bottom portion of the goods 40 placed on top of the base cap 10. In one embodiment, flaps 12 can be either folded down to cover part of the pallet or folded up to cover part of the goods. The folded flaps 12 create a vertical surface onto which a cover 90 (FIG. 3) or wrapping 80 (FIG. 4) may be attached and sealed.

Step 820: Position goods onto the base cap. The goods can be positioned on the base cap and pallet manually by workers or by a worker with a pallet squeeze. Alternatively, a forklift or overhead crane or even an industrial robot can mechanically position the goods. Similarly, packaging materials may be placed around the goods. The goods may also be glued, taped, or otherwise secured to the base cap. Again, this securing process can be accomplished manually or mechanically through a device such an industrial robot.

Step 830: Position the top cap over the stacked containers or boxes of goods, as illustrated in FIG. 4. A machine such as a forklift, crane, or industrial arm, as described above can position the top cap manually or mechanically. FIG. 4 shows the top cap with side walls or flaps 22. The flaps 22 may be folded down to cover a portion of the top boxes of goods. A robot arm can accomplish the folding mechanically, for example. After folding, the flaps 22 can be secured to the goods by glue, tape or similar substances. The folded flaps 22 create a vertical surface on which to connect a wrapping 80 (FIG. 4).

Step 840: Apply a wrap covering. The wrapping may be applied by circling one or more rolls of wrapping 80 (FIGS. 9 and 10) around the pallet assembly so as to create an enclosure around the goods in conjunction with the top and bottom caps. FIG. 4 illustrates a preferred application of wrapping 80, which includes overlapping the wrapping over base cap 10 and top cap 20. However, the wrapping 80 can be applied using any one of numerous methods well known in the art. For example the transporter could pour, spray, spin, etc., the cover onto the palletized goods. Preferably, the application creates a smooth seal between the palletized goods and the cover. Alternatively, a worker can manually apply the wrapping by walking around a pallet assembly while dispensing the wrapping. Alternatively, the worker can spin the pallet assembly near a wrapping dispenser. The wrapping machines previously described with respect to FIGS. 9 and 10 can also apply the wrapping. Optionally after positioning, the wrapping is secured to the caps and goods by various methods such as by heating, taping, zip-sealing and/or gluing the wrapping to the top and base caps.

Step 850: Inject or establish the proper atmosphere in the sealed enclosure and, as required during the injection or metering process, vent sealed enclosure to allow for rapid and efficient replacement of the enclosure atmosphere. The proper atmosphere can be accomplished in the following ways:

a) in one embodiment, the method automatically measures and adjusts the $CO_2$ and $O_2$ levels within the enclosure by use of the controllers previously described.

b) it is also possible to manually measure and adjust the amount of $CO_2$ and $N_2$ required within the enclosure. Based on sample test runs, a simple automated system based on a uniform sized sealed enclosure may be established.

c) the required atmosphere may be calculated based on injection time and pressures, net volume of space within the enclosure, the product's needs, etc. and then injected manually or via an automated system.

d) in another embodiment, the product respiration may create its own modified atmosphere within the sealed enclosure (where time, value and product sensitivity or other factors allow).

e) in another embodiment, a calculated amount of dry ice may be placed within the sealed enclosure to achieve a desired amount of $CO_2$.

The methods described in options a to c require a human to connect hoses and valves to the sealed enclosure to introduce the desired gases. Such hoses would interconnect air tanks or external gas sources ($CO_2$, $N_2$, etc) to the controller and to the sealed enclosure. A controller can then be used to control the emissions of gases from the tanks (or sources) into the enclosures by automatically opening and closing valves coupled between the air tanks (or sources) and the enclosure.

The above steps 810–850 may be repeated to create to separate enclosures on the same pallet. A new base cap 10, new goods 40, and a new top cap 20 can be placed over a completed pallet assembly. After the side wrapping 80 is applied, two separate internal enclosures exist on the same pallet.

Step 860: Apply controller. A controller can monitor and regulate the atmosphere within the sealed enclosure by implementing one of the processes illustrated in FIGS. 14–16, for example. Preferably, as previously discussed, the controller has connections which allow workers to snap hoses on and off the respective valves.

Figure 18:
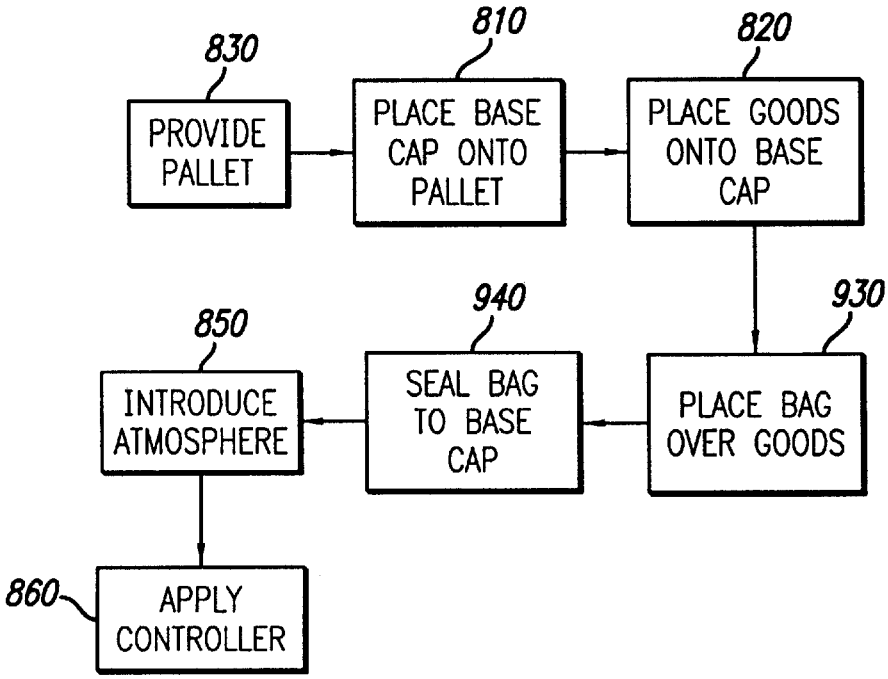
FIG. 18 is a flowchart of a method used to create and maintain a sealed enclosure with a bag cover and a base cap in accordance with one embodiment of the invention.

FIG. 18 illustrates an alternative pallet packing method in which a bag-type covering 90 (FIG. 3) is used instead of a top cap 20 and side wrapping 80. In this new method, Steps 930 and 940 replace Steps 830 and 840:

Step 930: Position Bag over goods. FIG. 3 illustrates a covering 90 positioned over goods 40. The covering 90 is installed by placing the open end over the top of the loaded pallet. The covering 90 may be installed either manually or automatically by a machine that positions the covering over the goods.

Step 940: Seal covering to base cap. The open end of the covering is secured to the base cap by various techniques such as by gluing or taping. The glue or tape can be manually applied or applied by a machine that circles the pallets. Sealing the sealed enclosure may be accomplished using wide adhesive tape, adhesive strips, stretch film, adhesive plastic film(s), or adhesive sealant sprayed or applied between the plastic bag or film wrap and the bottom cap or film, or any other method which is known to create an airtight enclosure. The introduction of atmosphere (Step 850) and the application of the controller (Step 860) are similar to those steps described above with respect to FIG. 17. Therefore, the description of those steps is not repeated here.

The invention described above provides an improved method and apparatus for transporting perishable and/or atmosphere-sensitive goods. Whereas particular embodiments of the present invention have been described above as examples, it will be appreciated that variations of the details may be made without departing from the scope of the invention. One skilled in the art will appreciate that the present invention can be practiced by other than the disclosed embodiments, all of which are presented in this description for purposes of illustration and not of limitation. It is noted that equivalents of the particular embodiments discussed in this description may practice the invention as well. Therefore, reference should be made to the appended claims rather than the foregoing discussion of preferred examples when assessing the scope of the invention in which exclusive rights are claimed.

What is claimed is:

1. A system for packaging goods, comprising:

a base cap having a top surface for receiving said goods thereon;

a covering surrounding and enclosing said goods between said base cap and said covering, thereby forming a sealed enclosure around said goods; and at least two valves coupled to said sealed enclosure allowing a desired gas to flow into an interior area of the sealed enclosure; wherein at least one valve is attached to and extends outwardly from a surface of said base cap or sealed enclosure and wherein at least one valve is attached to and extends outwardly from a surface of said covering;

wherein said at least two valves comprise a first valve and a second valve and the system further comprises:

a tank containing a gas therein;

a hose having a first end coupled to said first valve;

an automated valve coupled to said tank, wherein a second end of said hose is coupled to the automated valve;

at least one sensor coupled to said second valve, wherein the sensor receives an atmosphere sample from within said sealed enclosure via the second valve and measures at least one parameter associated with said atmosphere; and a controller coupled to said at least one sensor and said automated valve, wherein the controller receives data from said sensor and automatically opens or closes said automated valve in response to the data so as to either start or stop said gas from flowing into said sealed enclosure.

2. The system of claim 1, further comprising a pallet, wherein said base cap is configured to be received on top of said pallet.

3. The system of claim 2, wherein:

said pallet includes at least one slat; and said base cap includes at least one tab extending downwardly from a bottom surface of the base cap, wherein at least one tab is configured to be received within the at least one slat so as to align and secure the base cap to the pallet.

4. The system of claim 1, wherein said sensor periodically monitors said atmosphere within said sealed enclosure and periodically sends data to said controller, wherein said controller automatically opens or closes said automated valve in response to said data periodically received from said sensor so as to establish and/or maintain a desired atmosphere within said sealed enclosure.

5. The system of claim 1, further comprising a computer, coupled to said controller, wherein said computer receives and stores data representative of a measured characteristic of said desired atmosphere from said controller and said computer transmits instructions to said controller to initiate a desired operation by the controller.

6. A system for transporting or storing goods, comprising:

a base cap having a top surface for receiving said goods thereon, and a bottom surface;

a top cap having a top surface and a bottom surface, wherein the bottom surface of the top cap is configured to be positioned on top of said goods after the goods have been placed onto said top surface of the base cap;

a wrapping surrounding the side surfaces of said goods so as to form an enclosure around the goods in conjunction with said base cap and said top cap, wherein said wrapping overlaps said base cap and said top cap so as to form a sealed enclosure around said goods; and at least two valves coupled to said sealed enclosure for allowing a desired gas to flow into an interior area of the sealed enclosure, wherein at least one valve is attached to and extends outwardly from a surface of said base cap or sealed enclosure and at least one valve is attached to and extends outwardly from a surface of said wrapping overlapping said top cap;

wherein said at least two valves comprise a first valve and a second valve and the system further comprises:

a tank containing a gas source therein;

a hose having a first end coupled to said first valve;

an automated valve coupled to said tank, wherein a second end of said hose is coupled to the automated valve;

at least one sensor coupled to said second valve, wherein the sensor receives an atmosphere sample from within said sealed enclosure via the second valve and measures at least one parameter associated with said atmosphere; and a controller coupled to said at least one sensor and said automated valve, wherein the controller receives data from said sensors and automatically controls said automated valves in response to the data so as to either start or stop said gas from flowing into said sealed enclosure.

7. The system of claim 6, wherein said sensor periodically monitors said atmosphere within said sealed enclosure and periodically sends data to said controller, wherein said controller automatically opens or closes said automated valve in response to said data periodically received from said sensor so as to establish and/or maintain a desired atmosphere within said sealed enclosure.

8. The system of claim 6, further comprising a computer, coupled to said controller, wherein said computer receives and stores data representative of a measured characteristic of said desired atmosphere from said controller and said computer transmits instructions to said controller to initiate a desired operation by the controller.

9. The system of claim 6, further comprising a pallet, wherein said base cap is configured to be received on top of said pallet.

10. The system of claim 9, wherein:

said pallet includes at least one slat; and said base cap includes at least one tab extending downwardly from a bottom surface of the base cap, wherein at least one tab is configured to be received within the at least one slat so as to align and secure the base cap to the pallet.

11. A method of providing a desired atmosphere for goods, comprising:

providing a sealed enclosure around said goods wherein there are at least two valves coupled to said sealed enclosure allowing a desired gas to flow into an interior area of the sealed enclosure; wherein at least a first valve is attached to and extends outwardly from a surface of a base cap or sealed enclosure and wherein at least a second valve is attached to and extends outwardly from a surface of a covering;

coupling at least the first or second valve to said sealed enclosure so as to provide a port through which a desired gas from an external gas source may enter the sealed enclosure;

coupling a first end of a hose to said at least the first or second valve and a second end of the hose to said external gas source, thereby providing a conduit through which said desired gas may flow from said external gas source into said sealed enclosure;

injecting a desired gas from the external gas source into said sealed enclosure so as to provide a desired atmosphere within the sealed enclosure;

automatically monitoring an amount of gas which enters said sealed enclosure from said external source; and controlling the flow of said desired gas into said sealed enclosure in response to said act of automatically monitoring.

12. The method of claim 11, further comprising evacuating air from within said sealed enclosure prior to said act of injecting said desired gas into the sealed enclosure.

13. The method of claim 11, wherein said act of automatically monitoring comprises measuring a concentration level of said desired gas during said act of injecting so as to determine when a desired level of said gas has been injected into said sealed enclosure.

14. The method of claim 11, wherein said act of automatically monitoring comprises measuring a volume of said desired gas flowing into said sealed enclosure so as to determine when a desired amount of said gas has been injected into said sealed enclosure.

15. The method of claim 11, wherein:

said step of automatically monitoring comprises:

storing a target parameter within a memory coupled to a controller;

sampling said desired atmosphere within said enclosure at predetermined time intervals and measuring a predetermined characteristic of said atmosphere sample; and comparing said measured characteristic of the atmosphere sample with the target parameter; and said step of controlling the flow of said desired gas comprises:

opening an automated valve coupled to said sealed enclosure so as to allow said desired gas to flaw from said external gas source into said sealed enclosure if said act of comparing indicates a low level of said desired gas within said sealed enclosure; and closing the automated valve if said act of comparing indicates that a target level of said desired gas has been reached.

16. The method of claim 15, further comprising providing an alarm signal when said step of comparing said measured characteristic of said atmosphere sample with said target parameter indicates that the measured characteristic of the atmosphere sample is not within a specified range of the target parameter.

17. The method of claim 15, further comprising:

transmitting data corresponding to said measured characteristic from said controller to a computer, coupled to the controller; and transmitting instructions from the computer to the controller to initiate said acts of automatically monitoring and controlling by the controller.

18. The method of claim 11, further comprising:

automatically and periodically monitoring said desired atmosphere within said enclosure during transportation or storage of said goods; and automatically controlling the level of said desired gas within said sealed enclosure during transportation or storage of said goods by automatically injecting a desired amount of said desired gas from said external gas source into said sealed enclosure in response to said act of automatically and periodically monitoring so as to maintain said desired atmosphere within the sealed enclosure.

19. The method of claim 18, wherein:

said step of automatically and periodically monitoring said desired atmosphere within said sealed enclosure comprises transmitting data representative of a measured characteristic of said desired atmosphere to a computer which is remotely linked to a controller coupled to said external gas source and said sealed enclosure; and said step of automatically controlling the level of said desired gas within said sealed enclosure during transportation or storage of said goods, comprises transmitting command signals from said remote computer to said controller.

20. The method of claim 11, wherein said act of providing a sealed enclosure around said goods, comprises:

providing a pallet;

positioning a base cap on a top surface of the pallet;

positioning the goods on a top surface of the base cap;

positioning a top cap of the goods; and covering the exposed side surfaces of the goods between the top cap and the base cap with a desired material, wherein the desired material, the top cap and the base cap form said sealed enclosure around the goods.

21. The method of claim 11, wherein said act of providing a sealed enclosure around said goods, comprises:

positioning a base cap on a top surface of the pallet;

positioning the goods on a top surface of the base cap; and placing a cover over the goods and sealing the cover around the base cap such that the cover and the base cap form said sealed enclosure around the goods.

* * * * *